US012369709B2

(12) United States Patent
Choi

(10) Patent No.: US 12,369,709 B2
(45) Date of Patent: Jul. 29, 2025

(54) FRAME WITH IMPROVED STABILITY AND SAFETY

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 71 days.

(21) Appl. No.: 18/359,692

(22) Filed: Jul. 26, 2023

(65) Prior Publication Data

US 2024/0016288 A1 Jan. 18, 2024

Related U.S. Application Data

(63) Continuation-in-part of application No. 18/316,936, filed on May 12, 2023, now abandoned, which is a continuation of application No. 17/590,180, filed on Feb. 1, 2022, now Pat. No. 11,678,740.

(30) Foreign Application Priority Data

Mar. 16, 2021 (CN) ..... 202120545235.4
May 23, 2023 (CN) ..... 202321370911.4
May 31, 2023 (CN) ..... 202321370893.X

(51) Int. Cl.
*A47B 3/091* (2006.01)
*A47B 3/083* (2006.01)

(52) U.S. Cl.
CPC ..... *A47B 3/0915* (2013.01); *A47B 3/083* (2013.01)

(58) Field of Classification Search
CPC ..... A47B 3/083; A47B 3/0915
USPC ..... 108/166–169
See application file for complete search history.

(56) References Cited

U.S. PATENT DOCUMENTS 1,063,642 A 6/1913 Birdsell
1,981,052 A * 11/1934 Lehner ..... A47B 3/0915 160/128
2,136,569 A 11/1938 Trimpi
2,803,033 A 8/1957 Rachman
2,803,050 A 8/1957 Birger Fernberg
(Continued)

FOREIGN PATENT DOCUMENTS

CA 2971886 A1 12/2018
DE 4321853 A1 1/1995
(Continued)

*Primary Examiner* — Matthew W Ing
(74) *Attorney, Agent, or Firm* — MORGAN, LEWIS & BOCKIUS LLP

(57) ABSTRACT

A foldable frame includes first and second units pivotally coupled with each other at their proximal sides and rotatable with respect to each other between a folded state and an unfolded state. The foldable frame also includes a middle leg assembly coupled with the first and second units at the proximal sides of the first and second units. The foldable frame further includes a safety enhancement assembly having a first enhancement member, a second enhancement member and a locking mechanism. The first enhancement member is connected to the first unit and the middle leg assembly. The second enhancement member is connected to the second unit and the middle leg assembly. The locking mechanism selectively locks the first and second enhancement members when the first and second units are in the unfolded state, and thus prevents accidental folding of the first and second units.

17 Claims, 25 Drawing Sheets

(56) References Cited

U.S. PATENT DOCUMENTS

| | | | |
|---|---|---|---|
| 2,868,599 | A | 1/1959 | Roggio |
| 3,075,809 | A | 1/1963 | Wilson |
| 3,187,373 | A | 6/1965 | Fisher |
| 3,368,504 | A | 2/1968 | Cohen |
| 3,410,232 | A | 11/1968 | Bills |
| 3,410,327 | A | 11/1968 | Ausnit |
| 3,861,328 | A | 1/1975 | Lawless |
| 4,191,111 | A | 3/1980 | Emmert |
| 4,285,105 | A | 8/1981 | Kirkpatrick |
| 4,561,108 | A | 12/1985 | Kamp |
| 4,792,240 | A | 12/1988 | Ausnit |
| 5,325,794 | A | 7/1994 | Hontani |
| 5,392,718 | A | 2/1995 | Stevens |
| 5,483,710 | A | 1/1996 | Chan |
| 5,745,954 | A | 5/1998 | Shogan |
| 5,857,229 | A | 1/1999 | Magnani, Jr. |
| 5,921,623 | A | 7/1999 | Nye |
| 6,223,366 | B1 | 5/2001 | Cheng |
| 6,347,831 | B1 | 2/2002 | Nye |
| 6,363,550 | B1 | 4/2002 | Wang |
| 6,508,262 | B1 | 1/2003 | Takayama |
| 6,644,734 | B1 | 11/2003 | Tseng |
| 6,843,183 | B2 | 1/2005 | Strong |
| 6,971,321 | B1 | 12/2005 | Strong |
| 7,059,254 | B2 | 6/2006 | Strong et al. |
| 7,096,799 | B2 | 8/2006 | Strong et al. |
| 7,097,380 | B2 | 8/2006 | Lee |
| 7,171,910 | B2 | 2/2007 | Neunzert et al. |
| 7,260,871 | B2 | 8/2007 | Borchardt |
| 7,428,872 | B2 | 9/2008 | Strong et al. |
| 7,475,643 | B2 | 1/2009 | Haney et al. |
| 7,475,644 | B2 | 1/2009 | Strong et al. |
| 7,634,969 | B2 | 12/2009 | Neunzert et al. |
| 7,640,870 | B2 | 1/2010 | Strong et al. |
| 7,644,667 | B2 | 1/2010 | Strong et al. |
| 7,735,431 | B2 | 6/2010 | Neunzert et al. |
| 7,874,303 | B2 | 1/2011 | Xie |
| 8,006,630 | B2 | 8/2011 | Strong et al. |
| 8,033,228 | B2 | 10/2011 | Haney et al. |
| 8,042,475 | B2 | 10/2011 | Larcom et al. |
| 8,113,130 | B2 | 2/2012 | Leng |
| 8,132,517 | B2 | 3/2012 | Leng |
| 8,156,875 | B2 | 4/2012 | Neunzert et al. |
| 8,302,541 | B2 | 11/2012 | Haney et al. |
| 8,342,107 | B2 | 1/2013 | Mover et al. |
| 8,534,205 | B1 | 9/2013 | Johnson et al. |
| 8,578,865 | B2 | 11/2013 | Haney et al. |
| 8,622,007 | B2 | 1/2014 | Peery et al. |
| 8,746,155 | B2 | 6/2014 | Haney et al. |
| 8,757,069 | B2 | 6/2014 | Peery et al. |
| 8,904,943 | B2 | 12/2014 | Jin |
| 9,027,952 | B2 | 5/2015 | Zhu |
| 9,103,368 | B2 | 8/2015 | Mendes |
| D748,418 | S | 2/2016 | Johnson et al. |
| 9,277,808 | B2 | 3/2016 | Cai et al. |
| 9,282,812 | B2 | 3/2016 | Chang |
| D756,694 | S | 5/2016 | Johnson et al. |
| 9,351,563 | B2 | 5/2016 | Bennett et al. |
| 9,462,880 | B1 | 10/2016 | Lin |
| 10,159,334 | B1 | 12/2018 | Wang |
| 10,470,561 | B2 | 11/2019 | Clegg et al. |
| 10,806,248 | B1 * | 10/2020 | Chen ..... A47B 3/0818 |
| 11,234,525 | B1 | 2/2022 | Tsai |
| 2003/0089286 | A1 | 5/2003 | Wang |
| 2004/0070235 | A1 | 4/2004 | Gregory |
| 2004/0187749 | A1 | 9/2004 | Zhurong |
| 2004/0195869 | A1 | 10/2004 | Zhurong |
| 2005/0005826 | A1 | 1/2005 | Strong |
| 2005/0097829 | A1 | 5/2005 | Seo |
| 2005/0241550 | A1 | 11/2005 | Neunzert |
| 2005/0279260 | A1 | 12/2005 | Stanford |
| 2006/0062632 | A1 | 3/2006 | Jang |
| 2006/0181114 | A1 | 8/2006 | Nye |
| 2006/0196395 | A1 | 9/2006 | Lin |
| 2007/0079441 | A1 | 4/2007 | Chen |
| 2008/0078310 | A1 | 4/2008 | VanNimwegen |
| 2013/0000528 | A1 | 1/2013 | Jin |
| 2013/0025509 | A1 | 1/2013 | Jin |
| 2013/0233210 | A1 | 9/2013 | Jin |
| 2014/0030012 | A1 | 1/2014 | Lee |
| 2014/0070070 | A1 | 3/2014 | Shinoda |
| 2014/0099155 | A1 | 4/2014 | Chen |
| 2014/0130837 | A1 | 5/2014 | Sy-Facunda |
| 2016/0348395 | A1 | 12/2016 | Jin |
| 2017/0013955 | A1 | 1/2017 | Lin |
| 2017/0325592 | A1 | 11/2017 | Suh |
| 2017/0340100 | A1 | 11/2017 | Tsai |
| 2018/0153302 | A1 | 6/2018 | Jiang |
| 2018/0171648 | A1 | 6/2018 | Woodward |
| 2019/0150608 | A1 | 5/2019 | Johnson et al. |
| 2019/0284831 | A1 | 9/2019 | Volin |
| 2019/0292808 | A1 | 9/2019 | Dotterweich |
| 2020/0029684 | A1 | 1/2020 | Jiang |
| 2020/0390233 | A1 * | 12/2020 | Leng ..... A47B 3/0915 |
| 2021/0112968 | A1 | 4/2021 | Ponomar |
| 2021/0177135 | A1 | 6/2021 | Leng |
| 2021/0222823 | A1 * | 7/2021 | Choi ..... F16M 11/38 |
| 2021/0274929 | A1 | 9/2021 | Choi |
| 2021/0274930 | A1 | 9/2021 | Choi |
| 2022/0022643 | A1 | 1/2022 | Choi |

FOREIGN PATENT DOCUMENTS

| | | | |
|---|---|---|---|
| DE | 29515948 | U1 | 1/1996 |
| EP | 1492432 | B1 | 10/2016 |
| WO | WO 2013000149 | A1 | 1/2013 |

* cited by examiner

FRAME WITH IMPROVED STABILITY AND SAFETY

CROSS-REFERENCE TO RELATED APPLICATIONS

The present application claims priority to Chinese Applications CN 202321370893.X filed May 31, 2023 and CN 202321370911.4 filed May 31, 2023, and is a continuation-in-part of U.S. patent application Ser. No. 18/316,936 filed May 12, 2023, which is a continuation of U.S. patent application Ser. No. 17/590,180 filed Feb. 1, 2022 and issued as U.S. Pat. No. 11,678,740, which claims priority to Chinese Application CN 202120545235.4 filed Mar. 16, 2021. The disclosures of the applications are incorporated herein for all purposes by reference in its entirety.

FIELD OF THE INVENTION

The present invention generally relates to frames and, in particular, to foldable frames with minimized thicknesses when folded and/or with improved stability and safety when unfolded and in use.

BACKGROUND

Foldable structures (e.g., tables, benches) are more and more popular these days. A typical structure usually includes a foldable frame to support a panel. However, many existing foldable frames are bulky when folded. For instance, some components may overlap with other components when folded, resulting in a folded frame with a larger size or thickness. Moreover, some existing foldable frames may fold in half unintentionally, pinching and injuring users' hands. Such foldable frames are not safe to use.

Given the current state of the art, there remains a need for frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable frames with minimized thicknesses when folded and/or with improved stability and safety when unfolded and in use.

In various exemplary embodiments, the present disclosure provides a foldable frame including first and second mounting assemblies, and first, second and third leg assemblies. The first and second mounting assemblies are pivotally coupled with each other at proximal sides thereof. The first leg assembly includes a first upper member pivotally coupled with the first mounting assembly at a distal side of the first mounting assembly and a first base member for abutting a ground when the first mounting assembly is in use. The second leg assembly includes a second upper member pivotally coupled with the second mounting assembly at a distal side of the second mounting assembly and a second base member for abutting a ground when the second mounting assembly is in use. The third leg assembly includes a third upper member coupled with the first and second mounting assemblies at the proximal sides of the first and second mounting assemblies and a third base member for abutting a ground when the third mounting assembly is in use. The first, second and third upper members are disposed substantially parallel to each other, and a distance between the first and third upper members is different than a distance between the second and third upper members such that the first, second and third base members are disposed side by side when the foldable frame is folded along a longitudinal direction of the foldable frame.

In some exemplary embodiments, the distance between the first and third upper members is shorter than a distance between the second and third upper members such that the first base member is disposed between the second and third base members when the foldable frame is folded along the longitudinal direction of the foldable frame.

In some exemplary embodiments, each of the first, second and third leg assemblies includes at least one leg. The first base member is disposed at an exterior side of a lower end portion of the at least one leg of the first leg assembly. The second base member is disposed at an exterior side of a lower end portion of the at least one leg of the second leg assembly. The third base member is disposed at a lower side of a lower end portion of the at least one leg of the third leg assembly.

In some exemplary embodiments, the foldable frame further includes first and second supporting assemblies. The first supporting assembly is coupled with the first leg assembly and first mounting assembly and configured to control rotation of the first leg assembly with respect to the first mounting assembly. The second supporting assembly is coupled with the second leg assembly and second mounting assembly and configured to control rotation of the second leg assembly with respect to the second mounting assembly.

In some exemplary embodiments, each of the first and second mounting assemblies includes a first mounting member and a second mounting member. The first mounting members of the first and second mounting assemblies are pivotally coupled with each other by a first coupler. The second mounting members of the first and second mounting assemblies are pivotally coupled with each other by a second coupler. The first upper member has an end portion pivotally coupled with the first mounting member of the first mounting assembly, and another end portion pivotally coupled with the second mounting member of the first mounting assembly. The second upper member has an end portion pivotally coupled with the first mounting member of the second mounting assembly, and another end portion pivotally coupled with the second mounting member of the second mounting assembly. The third upper member has an end portion coupled with the first coupler and another end portion coupled with the second coupler.

In some exemplary embodiments, each of the first, second and third leg assemblies includes at least one leg having an upper end portion coupled with the first, second or third upper member and a lower end portion coupled with the first, second or third base member.

In some exemplary embodiments, each of the first and second leg assemblies further includes an intermediate member rotatably coupled with a middle portion of the at least one leg of the first and second leg assemblies. The foldable frame further includes first and second supporting assemblies. Each of the first and second supporting assemblies includes a controller, and first, second and third supporting members. The first supporting member has an end portion coupled with the intermediate member of the first or second leg assembly. The controller is coupled with the first supporting member and selectively movable along the first supporting member. The second supporting member has a first end portion coupled with the controller and a second end portion pivotally coupled with the first mounting member of the first or second mounting assembly. The third supporting member has a first end portion coupled with the controller and a second end portion pivotally coupled with the second mounting member of the first or second mounting assembly.

In an exemplary embodiment, the at least one leg of the first or second leg assembly includes a first leg and a second leg. The intermediate member of the first or second leg assembly has an end portion pivotally coupled with a middle portion of the first leg and another end portion pivotally coupled with a middle portion of the second leg.

In an exemplary embodiment, the second or third supporting member includes a body member between the first and second end portions of the second or third supporting member, and the first and second end portions of the second or third supporting member is bent with respect to the body member of the second or third supporting member in substantially opposite directions.

In some exemplary embodiments, the second end portion of the second supporting member is disposed at an interior side of the first mounting member of the first or second mounting assembly, and the second end portion of the third supporting member is disposed an interior side of the second mounting member of the first or second mounting assembly, such that when the first and second leg assemblies are folded, the first supporting assembly is disposed substantially in a plane defined by the first mounting assembly and the second supporting assembly is disposed substantially in a plane defined by the second mounting assembly.

In an exemplary embodiment, the foldable frame further includes third and fourth couplers. The third coupler is disposed at the first or second mounting member of the first mounting assembly, and the fourth coupler is disposed at the first or second mounting member of the second mounting assembly. When the foldable frame is folded, the third and fourth couplers are coupled with each other to prevent accidental unfolding of the foldable frame.

In various exemplary embodiments, the present disclosure provides a foldable frame including first and second mounting assemblies, first and second leg assemblies, and first and second supporting assemblies. Each of the first and second mounting assemblies a first mounting member and a second mounting member. The first mounting members of the first and second mounting assemblies are pivotally coupled with each other at proximal sides thereof. The second mounting members of the first and second mounting assemblies are pivotally coupled with each other at proximal sides thereof. Each of the first and second leg assemblies includes an upper member, at least one leg, and an intermediate member. The upper member is pivotally coupled with the first and second mounting members of the first or second mounting assembly at a distal side of the first or second mounting assembly. The at least one leg has an upper end portion coupled with the upper member. The intermediate member is rotatably coupled with a middle portion of the at least one leg. Each of the first and second supporting assemblies includes a controller, and first, second and third supporting members. The first supporting member is coupled with the intermediate member of the first or second leg assembly. The controller is coupled with the first supporting member and selectively movable along the first supporting member. The second supporting member has a first end portion coupled with the controller and a second end portion disposed at an interior side of the first mounting member of the first or second mounting assembly and pivotally coupled with the first mounting member of the first or second mounting assembly. The third supporting member has a first end portion coupled with the controller and a second end portion disposed at an interior side of the second mounting member of the first or second mounting assembly and pivotally coupled with the second mounting member of the first or second mounting assembly. When the first and second leg assemblies are folded, the first supporting assembly is disposed substantially in a plane defined by the first mounting assembly and the second supporting assembly is disposed substantially in a plane defined by the second mounting assembly.

In an exemplary embodiment, the at least one leg of the first or second leg assembly includes a first leg and a second leg. The intermediate member of the first or second leg assembly has an end portion pivotally coupled with a middle portion of the first leg and another end portion pivotally coupled with a middle portion of the second leg.

In some exemplary embodiments, each of the first and second leg assemblies further includes a base member. When the foldable frame is unfolded and in use, the base member of each of the first and second leg assemblies abuts a ground. When the foldable frame is folded, the base members of the first and second leg assemblies are disposed between the first or second mounting member of the first mounting assembly and the first or second mounting member of the second mounting assembly.

In some exemplary embodiments, the first mounting members of the first and second mounting assemblies are pivotally coupled with each other by a first coupler, and the second mounting members of the first and second mounting assemblies are pivotally coupled with each other by a second coupler.

In some exemplary embodiments, the foldable frame further includes a third leg assembly. An upper member of the third leg assembly has an end portion coupled with the first coupler and another end portion coupled with the second coupler.

In an exemplary embodiment, each of the first, second and third leg assemblies includes a base member for abutting a ground when the first, second and mounting assemblies are in use.

In some exemplary embodiments, the upper members of the first, second and third leg assemblies are disposed substantially parallel to each other, and a distance between the upper members of the first and third leg assemblies is different than a distance between the upper members of the second and third leg assemblies, such that the base members of the first, second and third leg assemblies are disposed side by side when the foldable frame is folded along a longitudinal direction of the frame.

In an exemplary embodiment, the distance between the upper members of the first and third leg assemblies is shorter than the distance between the upper members of the second and third leg assemblies such that the base member of the first leg assembly is disposed between the base members of the second and third leg assemblies when the foldable frame is folded along the longitudinal direction of the frame.

In an exemplary embodiment, the base member of the first leg assembly is disposed at an exterior side of a lower end portion of the at least one leg of the first leg assembly. The base member of the second leg assembly is disposed at an exterior side of a lower end portion of the at least one leg of the second leg assembly. The base member of the third leg assembly is disposed at a lower side of a lower end portion of the at least one leg of the third leg assembly.

In various exemplary embodiments, the present disclosure provides a foldable frame including a first frame unit, a second frame unit, a middle leg assembly, and a safety enhancement assembly. The first and second frame units are pivotally coupled with each other at proximal sides thereof and rotatable with respect to each other between a folded state and an unfolded state. The middle leg assembly is coupled with the first and second frame units at the proximal sides of the first and second frame units. The safety enhancement assembly is connected to the first frame unit, second frame unit and middle leg assembly to prevent accidental folding of the first and second frame units. The safety enhancement includes a locking mechanism, a first enhancement member and a second enhancement member. The locking mechanism is connected to the middle leg assembly. The first enhancement member is connected to the first frame unit and the locking mechanism. The second enhancement member is connected to the second frame unit and the locking mechanism. The locking mechanism selectively locks the first and second enhancement members when the first and second frame units are in the unfolded state, thereby preventing accidental folding of the first and second frame units.

In some exemplary embodiments, the locking mechanism includes a sliding member and a fastening member. The first enhancement member has one end portion pivotally connected to the first frame unit and another end portion pivotally connected to the sliding member. The second enhancement member has one end portion pivotally connected to the second frame unit and another end portion pivotally connected to the sliding member. The sliding member is coupled with the middle leg assembly and movable along a height direction of the middle leg assembly. The fastening member selectively locks the sliding member with the middle leg assembly to restrict the sliding member from moving along the height direction of the middle leg assembly when the first and second frame units are in the unfolded state, thereby selectively locking the first and second enhancement members when the first and second frame units are in the unfolded state and thus preventing accidental folding of the first and second frame units.

In some exemplary embodiments, the middle leg assembly includes a leg having a restriction hole, and the fastening member of the locking mechanism is a pin disposed in the sliding member and insertable into the restriction hole of the leg.

In some exemplary embodiments, the locking mechanism further includes an elastic member disposed in the sliding member to push the pin into the restriction hole when the pin is aligned with the restriction hole.

In some exemplary embodiments, the locking mechanism further includes an pressing member coupled with the sliding member for applying an external force on the elastic member to pull the pin out of the restriction hole.

In some exemplary embodiments, the sliding member includes a slot slidably engaged with a leg of the middle leg assembly.

In some exemplary embodiments, the sliding member includes a connecting shaft for pivotally connecting the first and second enhancement members.

In some exemplary embodiments, the locking mechanism includes a fixation member fixedly coupled with the middle leg assembly. The first enhancement member is coupled with the fixation member such that the fixation member is movable along a length direction of the first enhancement member, and the second enhancement member is coupled with the fixation member such that the fixation member is movable along a length direction of the second enhancement member. The first enhancement member includes a first restriction structure, and the second enhancement member includes a second restriction structure. The fixation member of the locking mechanism selectively engages with the first restriction structure of the first enhancement member and the second restriction structure of the second enhancement member when the first and second frame units are in the unfolded state, thereby selectively locking the first and second enhancement members when the first and second frame units are in the unfolded state and thus preventing accidental folding of the first and second frame units.

In some exemplary embodiments, the first enhancement member includes a first slot along at least a portion of the first enhancement member. The second enhancement member includes a second slot along at least a portion of the second enhancement member. The fixation member of the locking mechanism is movable along the first slot of the first enhancement member and the second slot of the second enhancement member.

In some exemplary embodiments, the first restriction structure is formed at an end of the first slot of the first enhancement member, and the second restriction structure is formed at an end of the second slot of the second enhancement member.

In some exemplary embodiments, the first enhancement member is connected to a first mounting assembly of the first frame unit and the second enhancement member is connected to a second mounting assembly of the second frame unit. The first and second mounting assemblies are pivotally coupled with each other at proximal sides thereof.

In some exemplary embodiments, the first frame unit further includes a first leg assembly pivotally coupled with the first mounting assembly at a distal side of the first mounting assembly and the second frame unit further includes a second leg assembly pivotally coupled with the second mounting assembly at a distal side of the second mounting assembly.

In some exemplary embodiments, the foldable frame further includes a first supporting assembly and a second supporting assembly. The first supporting assembly is coupled with the first leg assembly and first mounting assembly, and configured to control rotation of the first leg assembly with respect to the first mounting assembly. The second supporting assembly is coupled with the second leg assembly and second mounting assembly, and configured to control rotation of the second leg assembly with respect to the second mounting assembly.

In an exemplary embodiment, the first supporting assembly is coupled with an intermediate member of the first leg assembly and a lateral mounting bar of the first mounting assembly. The second supporting assembly is coupled with an intermediate member of the second leg assembly and a lateral mounting bar of the second mounting assembly.

In some exemplary embodiments, the first leg assembly includes a first upper member pivotally coupled with the first mounting assembly at a distal side of the first mounting assembly and a first base member for abutting a ground when the first mounting assembly is in use. The second leg assembly includes a second upper member pivotally coupled with the second mounting assembly at a distal side of the second mounting assembly and a second base member for abutting a ground when the second mounting assembly is in use. The middle leg assembly includes a third upper member coupled with the first and second mounting assemblies at the proximal sides of the first and second mounting assemblies and a third base member for abutting a ground when the third mounting assembly is in use. The first, second and third upper members are disposed substantially parallel to each other, and a distance between the first and third upper members is different than a distance between the second and third upper members such that the first, second and third base members are disposed side by side when the foldable frame is folded along a longitudinal direction of the foldable frame.

In an exemplary embodiments, the distance between the first and third upper members is shorter than a distance between the second and third upper members such that the first base member is disposed between the second and third base members when the foldable frame is folded along the longitudinal direction of the foldable frame.

In some exemplary embodiments, each of the first, second and middle leg assemblies includes at least one leg. The first base member is disposed at an exterior side of a lower end portion of the at least one leg of the first leg assembly. The second base member is disposed at an exterior side of a lower end portion of the at least one leg of the second leg assembly. The third base member is disposed at a lower side of a lower end portion of the at least one leg of the middle leg assembly.

In some exemplary embodiments, the first and second frame units are unsymmetric.

In various exemplary embodiments, the present disclosure provides a foldable frame including a first frame unit, a second frame unit, a middle leg assembly and a safety enhancement assembly. The first and second frame units are pivotally coupled with each other at proximal sides thereof and rotatable with respect to each other between a folded state and an unfolded state. Each of the first and second frame units includes a first mounting member at a first side of the foldable frame. The middle leg assembly is coupled with the first and second frame units at the proximal sides of the first and second frame units. The middle leg assembly includes a leg at the first side of the foldable frame. The safety enhancement assembly is disposed at the first side of the foldable frame. The safety enhancement assembly includes a sliding member, a first enhancement member, a second enhancement member, and a fastening member. The sliding member is coupled with the leg of the middle leg assembly and movable along a length direction of the leg of the middle leg assembly. The first enhancement member is pivotally connected to the first mounting member of the first frame unit and the sliding member. The second enhancement member is pivotally connected to the second mounting member of the second frame unit and the sliding member. The fastening member is configured to selectively lock the sliding member with the leg of the middle leg assembly when the first and second frame units are in the unfolded state, thereby restricting the sliding member from moving along the leg of the middle leg assembly.

In some exemplary embodiments, the fastening member is a pin disposed in the sliding member and is selectively inserted into a restriction hole on the leg of the middle leg assembly to restrict movement of the sliding member relative to the leg of the middle leg assembly.

The safety enhancement assemblies and frames of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
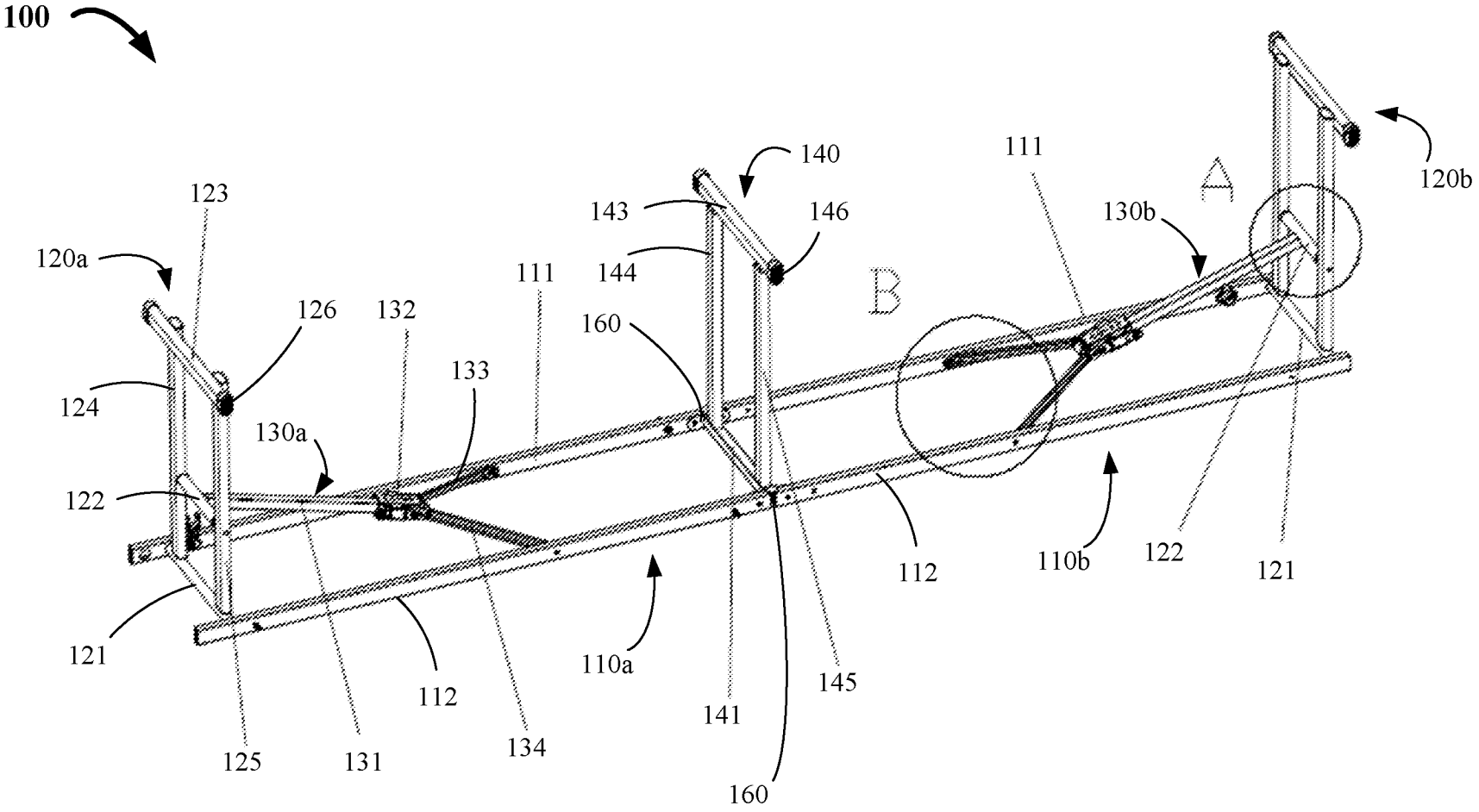
FIG. 1 is a bottom perspective view schematically illustrating an exemplary foldable frame in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable frames. The frames can be used to make benches, tables, beds or the like. The frames are of various sizes and of various shapes including but not limited to rectangles and squares. In addition, the frames can be made of various materials including but not limited to metals (e.g., iron, steel, and aluminum), plastics and woods. In some exemplary embodiments, some components of a frame (e.g., bars) are made of metals or the like while some other components (e.g., controllers, anti-slip members) are made of plastics, rubbers or the like.

A frame of the present disclosure generally includes first and second mounting assemblies pivotally coupled with each other at their proximal sides so that the first and second mounting assemblies are foldable onto each other. A frame of the present disclosure also includes leg assemblies to support the mounting assemblies. In some exemplary embodiments, a frame of the present disclosure further includes supporting assemblies, each configured to control rotation of a leg assembly, to stabilize the leg assembly when in use, and/or to help support the mounting assemblies when the frame is unfolded. The mounting assemblies, leg assemblies and/or supporting assemblies are configured and sized to minimize the thickness of the folded frame. Such a folded frame requires less storage space and is easy to carry around.

Referring now to FIGS. 1-6, there is depicted exemplary foldable frame 100 in accordance with some exemplary embodiments of the present disclosure. Frame 100 includes a first mounting assembly such as first mounting assembly 110*a* and a second mounting assembly such as second mounting assembly 110*b*. The first and second mounting assemblies can be but do not necessarily have to be identical or symmetric with respect to each other. By way of example, first mounting assembly 110*a* and second mounting assembly 110*b* are illustrated to be substantially the same and disposed symmetrically with respect to each other.

The first and second mounting assemblies are pivotally coupled with each other at their proximal sides, for instance, by one or more couplers such as coupler 160. As used herein, the sides at which first and second mounting assemblies are connected to each other are referred to as their proximal sides, and the sides opposite the proximal sides are referred to as their distal sides. For instance, in FIG. 1, the proximal sides of first and second mounting assemblies are in the middle of the foldable frame. The distal sides correspond to the left and right sides of the figure. It should be noted that the term "middle" as used herein does not necessarily mean the center of the frame, and the term "side" does not necessarily mean an outmost edge of the frame.

In some exemplary embodiments, each of the first and second mounting assemblies includes a first mounting member and a second mounting member. The first mounting members of the two mounting assemblies are pivotally coupled with each other at their proximal end portions, and the second mounting members of the two mounting assemblies are pivotally coupled with each other at their proximal end portions. For instance, in an exemplary embodiment, each of first mounting assembly 110*a* and second mounting assembly 110*b* includes first mounting member 111 and second mounting member 112. The proximal end portions of the first mounting members of the two mounting assemblies are pivotally coupled with each other by a first coupler (e.g., coupler 160 at the upper side of FIG. 1) and the proximal end portions of the second mounting members of the two mounting assemblies are pivotally coupled with each other by a second coupler (e.g., coupler 160 at the lower side of FIG. 1). The first and second mounting members can be but do not necessarily have to be straight or parallel to each other, and can be but do not necessarily have to be separated from each other.

Frame 100 also includes two or more leg assemblies. For instance, in some exemplary embodiments, frame 100 includes three leg assemblies, which can be configured the same as or differently from each other. By way of example, frame 100 is illustrated with first leg assembly 120*a*, second leg assembly 120*b* and third leg assembly 140, of which the first and second leg assemblies are substantially the same as each other. The first leg assembly is pivotally coupled with the first mounting assembly at a distal side of the first mounting assembly. The second leg assembly is pivotally coupled with the second mounting assembly at a distal side of the second mounting assembly. The third leg assembly is coupled with both of the first and second mounting assemblies at the proximal sides of the first and second mounting assemblies, for instance, through the first and second couplers.

First leg assembly 120*a* is pivotally coupled with first mounting assembly 110*a*, and second leg assembly 120*b* is pivotally coupled with second mounting assembly 110*b*. For instance, in some exemplary embodiments, the first or second leg assembly includes an upper member such as upper member 121 having a first end portion pivotally coupled with first mounting member 111 of the first or second mounting assembly and a second end portion pivotally coupled with second mounting member 112 of the first or second mounting assembly. In some embodiments, the upper member is a lateral bar disposed at the upper portion of the first or second leg assembly.

In some exemplary embodiments, the first or second leg assembly also includes one or more legs such as first leg 124 and second leg 125. The first and second legs can be but do not necessarily have to be straight or parallel to each other, and can be but do not necessarily have to be separated from each other. Each of the first and second legs has an upper end portion connected or formed with the upper member of the first or second leg assembly. In some exemplary embodiments, the first or second leg assembly further includes an intermediate member such as intermediate member 122 disposed between the first and second legs. The intermediate member has a first end portion connected or formed with the first leg and a second end portion connected or formed with the second leg of the first or second leg assembly. In some embodiments, the intermediate member is a lateral bar disposed at the middle portion of the first or second leg assembly.

In some exemplary embodiments, the first or second leg assembly further includes a base member such as base member 123, with which lower end portions of the first and second legs are connected or formed. In an exemplary embodiment, the base member is provided with one or more anti-slip members such as anti-slip member 126 to help stabilize the frame when in use. The anti-slip member can be a grip, a tube, a tape, a pad, or the like.

Third leg assembly 140 is coupled with both of the first and second mounting assemblies at the proximal sides of the first and second mounting assemblies. For instance, in some exemplary embodiments, leg assembly 140 includes an upper member such as upper member 141 having a first end portion coupled with the first coupler (e.g., coupler 160 at the upper side of FIG. 1) and a second end portion coupled with the second coupler (e.g., coupler 160 at the lower side of FIG. 1). Upper member 141 can be configured the same as or differently from upper member 121.

Similar to the first or second leg assembly, in some exemplary embodiments, third leg assembly 140 also includes one or more legs such as first leg 144 and second leg 145. Each of the first and second legs has an upper end portion connected to or formed with the upper member of the third leg assembly. The first and second legs of the third leg assembly can be but do not necessarily have to be the same as the first and second legs of the first or second leg assembly. Also, the first and second legs of the third leg assembly can be but do not necessarily have to be straight or parallel to each other. Further, the first and second legs of the third leg assembly can be but do not necessarily have to be separated from each other.

In some exemplary embodiments, third leg assembly 140 includes a base member such as base member 143, with which lower end portions of the first and second legs are connected or formed. In an exemplary embodiment, the base member is provided with one or more anti-slip members such as anti-slip member 146 to help stabilize the frame when in use. Base member 143 and anti-slip member 146 of the third leg assembly can be but do not necessarily have to be the same as base member 123 and anti-slip member 126 of the first or second leg assembly.

In various exemplary embodiments, frame 100 further includes one or more supporting assemblies, each configured to control rotation of a leg assembly, to stabilize a leg assembly when unfolded, or to help support one or more mounting assemblies. For instance, in some exemplary embodiments, frame 100 includes first and second supporting assemblies, such as first supporting assembly 130*a* and second supporting assembly 130*b*, which can be configured the same as or differently from each other. By way of example, frame 100 is illustrated the first and second supporting assemblies substantially the same as each other. The first supporting assembly is coupled with the first leg assembly and the first mounting assembly. The second supporting assembly is coupled with the second leg assembly and the second mounting assembly. Examples of supporting assemblies are disclosed in U.S. patent application Ser. No. 16/951,461, the disclosure of the application is incorporated herein for all purposes by reference in its entirety.

Figure 2A:
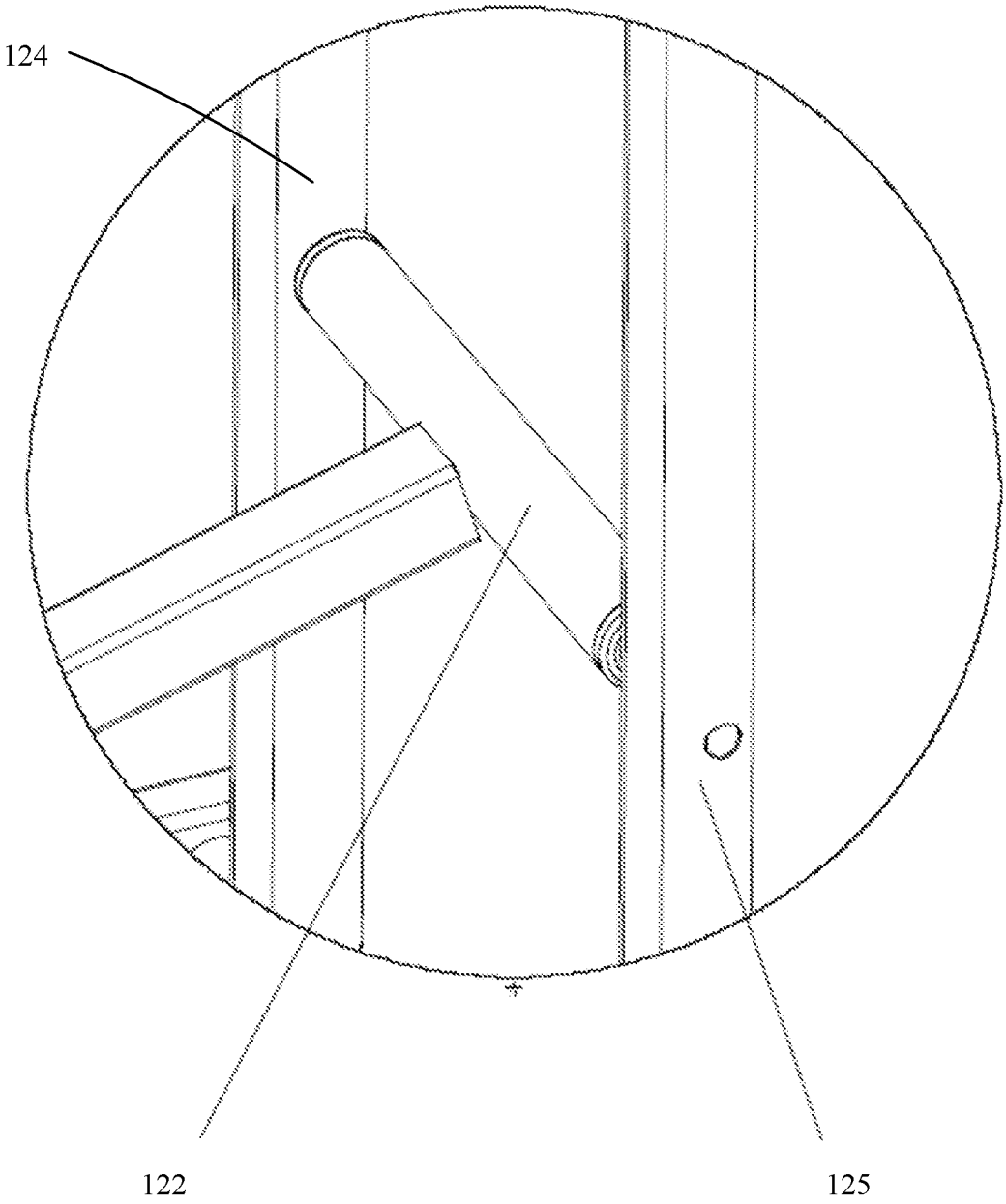
FIG. 2A is an enlarged view taken along circle A of the foldable frame of FIG. 1.
Figure 2B:
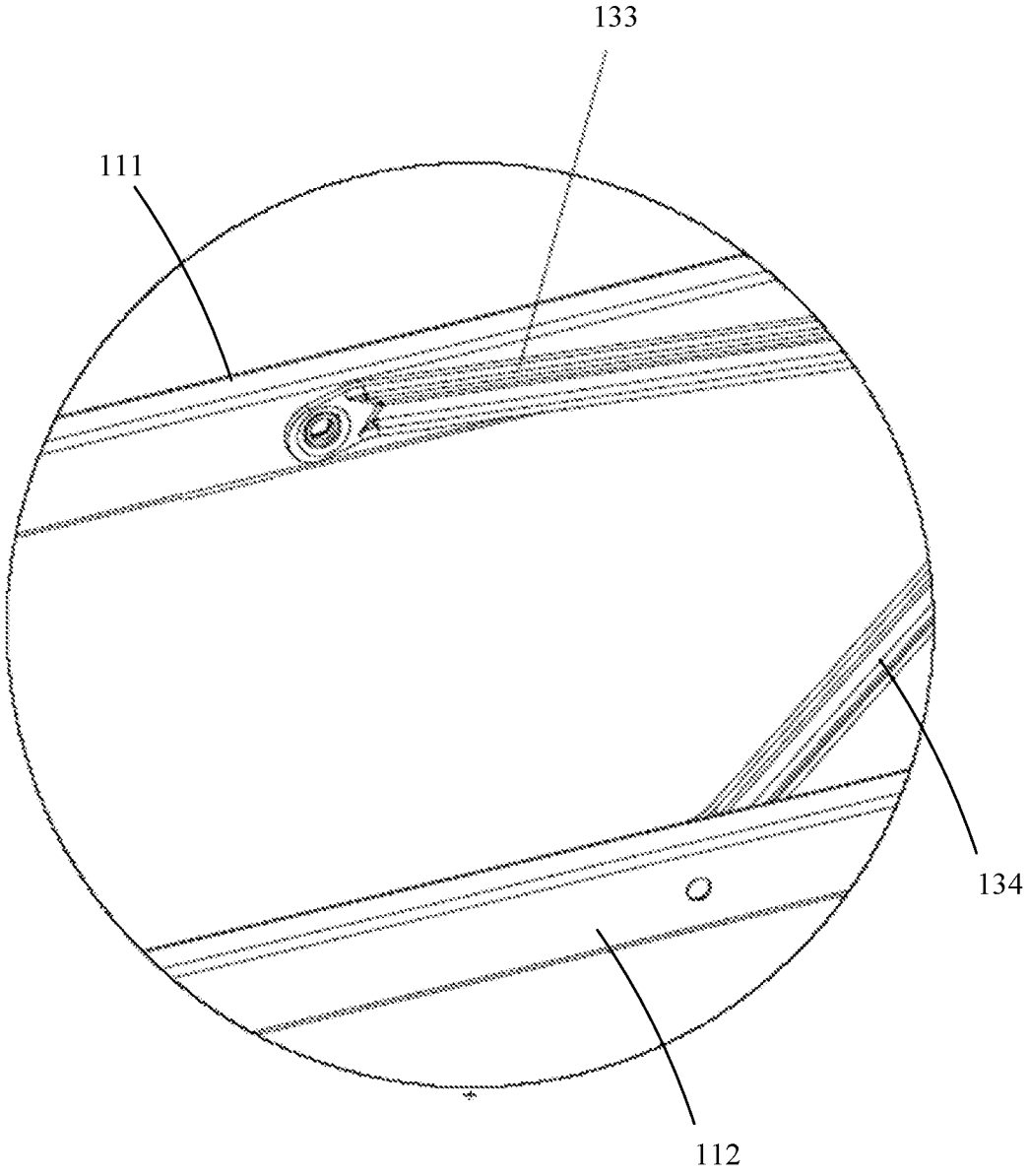
FIG. 2B is an enlarged view taken along circle B of the foldable frame of FIG. 1.

First supporting assembly 130*a* is pivotally coupled with first leg assembly 120*a* and first mounting assembly 110*a*. Similarly, second supporting assembly 130*b* is pivotally coupled with second leg assembly 120*b* and second mounting assembly 110*b*. For instance, in some exemplary embodiments, the first or second supporting assembly includes a first supporting member such as first supporting member 131, a controller such as controller 132, a second supporting member such as second supporting member 133 and a third supporting member such as third supporting member 134. First supporting member 131 is coupled with intermediate supporting member 122 of the first or second leg assembly. In some embodiments, first supporting member 131 is fixedly coupled with intermediate member 122 of the first or second leg assembly. Controller 132 is coupled with first supporting member 131 and selectively movable along the first supporting member. In an exemplary embodiment, controller 132 is configured to be a slider or to include a slider similar to those disclosed in U.S. patent application Ser. No. 16/838,939, Ser. No. 16/838,944 and Ser. No. 16/838,947, the disclosure of each application is incorporated herein for all purposes by reference in its entirety. Second supporting member 133 has a first end portion pivotally coupled with controller 132 and a second end portion pivotally coupled with first mounting member 111 of the first or second mounting assembly. Third supporting member 134 has a first end portion pivotally coupled with controller 132 and a second end portion pivotally coupled with second mounting member 112 of the first or second mounting assembly. In some embodiments, the second or third supporting member includes a body member between the first and second end portions of the second or third supporting member, and the first and second end portions of the second or third supporting member is bent with respect to the body member of the second or third supporting member in substantially opposite directions, as illustrated in FIG. 2B.

Figure 3:
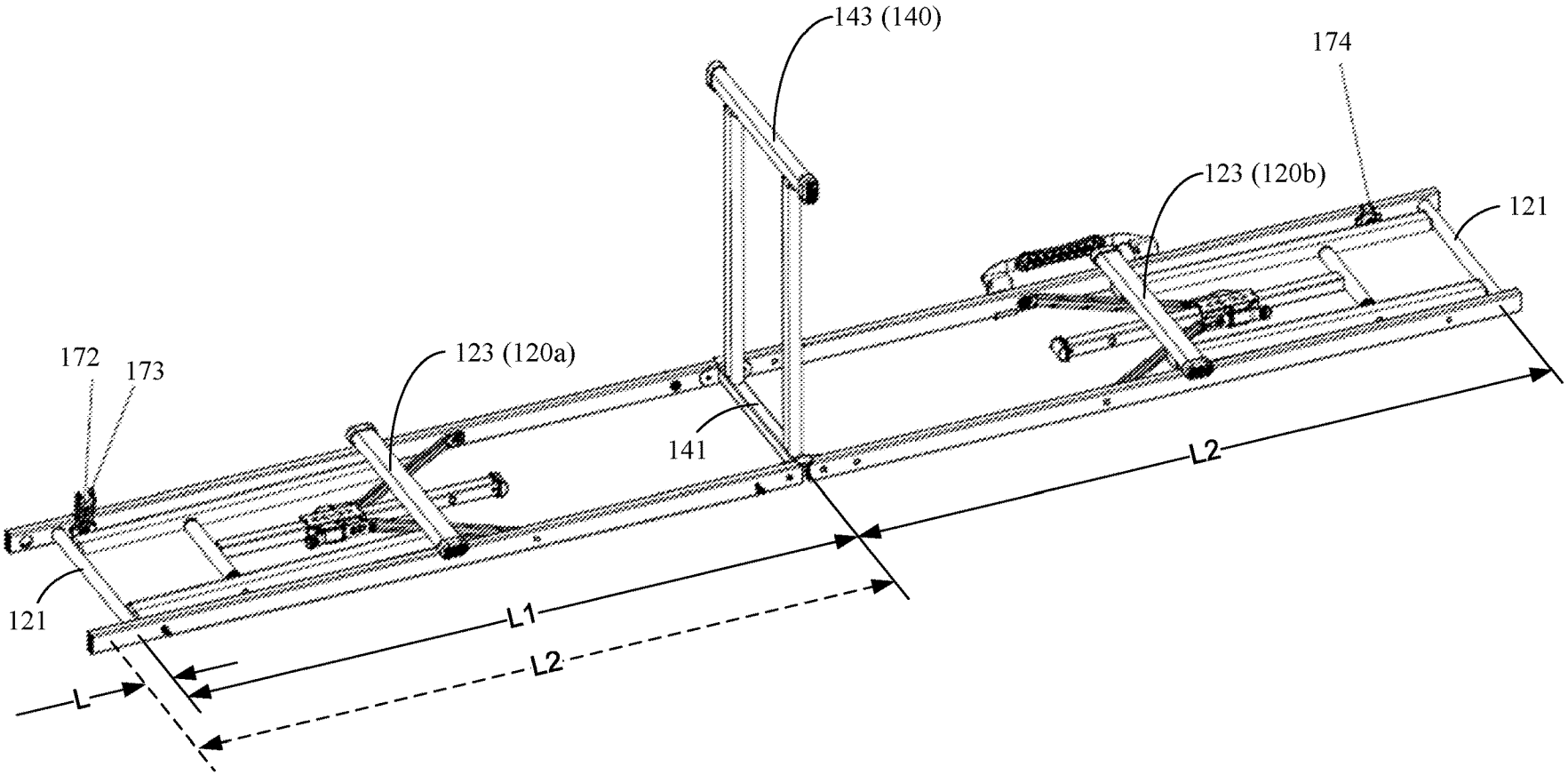
FIG. 3 is a perspective view schematically illustrating the foldable frame of FIG. 1 in an intermediate folding state in accordance with exemplary embodiments of the present disclosure.

First supporting assembly 130*a* is configured to control the rotation of first leg assembly 120*a* with respect to first mounting assembly 110*a*, and when the frame is unfolded, to stabilize first leg assembly 120*a* and help support first mounting assembly 110*a*. Similarly, second supporting assembly 130*b* is configured to control the rotation of second leg assembly 120*b* with respect to second mounting assembly 110*b*, and when the frame is unfolded, to stabilize second leg assembly 120*b* and help support second mounting assembly 110*b*. For instance, as the controller moves along the length direction of the first supporting member, the second and third supporting members move toward or away from the first supporting member, resulting in shortening or lengthening the total length of the first or second supporting assembly. In the meantime, each of the first, second and third supporting members also rotates. For instance, the first supporting member rotates along with the intermediate member of the first or second leg assembly. The second member rotates around the pivoting axis at which the second member is pivotally coupled with the first mounting member. The third member rotates around the pivoting axis at which the third member is pivotally coupled with the second mounting member. As such, the first or second supporting assembly allows the first or second leg assembly to rotate between a use position as illustrated in FIG. 1 and a storage position as illustrated in FIG. 3. When the first or second leg assembly is in the use position, the controller is restricted from moving along the first supporting member (e.g., by a pin or the like), thereby preventing the first, second and third supporting members from rotating and the total length of the supporting assembly from shortening or lengthening. As such, it prevents the leg assembly from accidental folding and thus helps stabilize the frame.

Figure 4A:
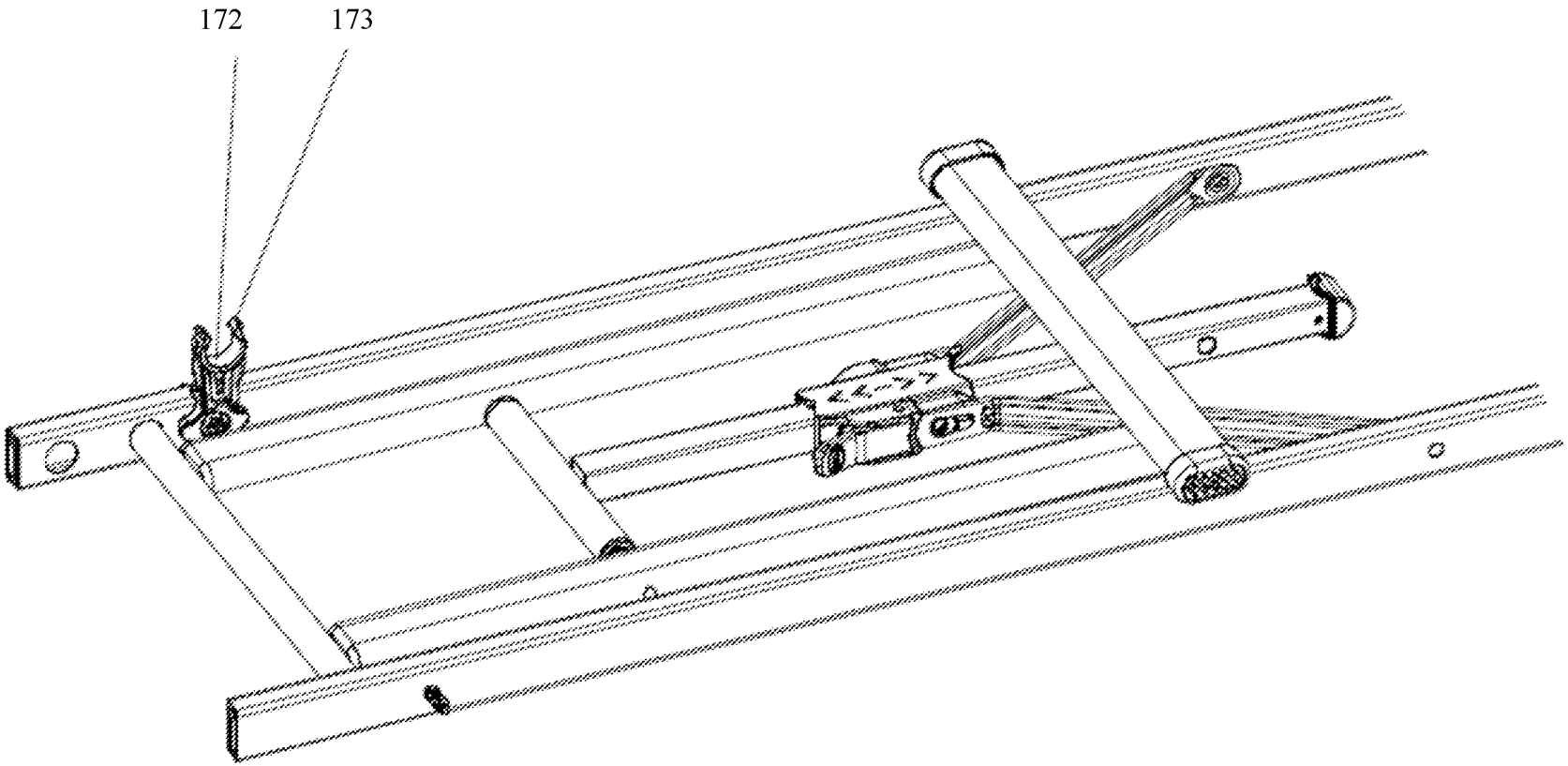
FIG. 4A is an enlarged view illustrating a portion of the foldable frame of FIG. 3.

Referring in particular to FIGS. 1, 3, 4A, 4B and 6, in some exemplary embodiments, base member 123 of first leg assembly 120*a* is disposed at an exterior side (e.g., the left side of FIG. 1) of a lower end portion of the at least one leg (e.g., legs 124 and 125) of the first leg assembly. As such, when the first leg assembly is folded, the first supporting assembly, along with the upper member and at least one leg of the first leg assembly, is disposed substantially in a plane defined by the first mounting assembly (e.g., by the first and second mounting members of the first mounting assembly) as illustrated in FIGS. 3 and 4A. In some exemplary embodiments, the first and second mounting members of the first mounting assembly, the first leg assembly except the base member, and the first supporting assembly are disposed in the same plane, thereby minimizing the thickness of the frame when it is folded.

Figure 4B:
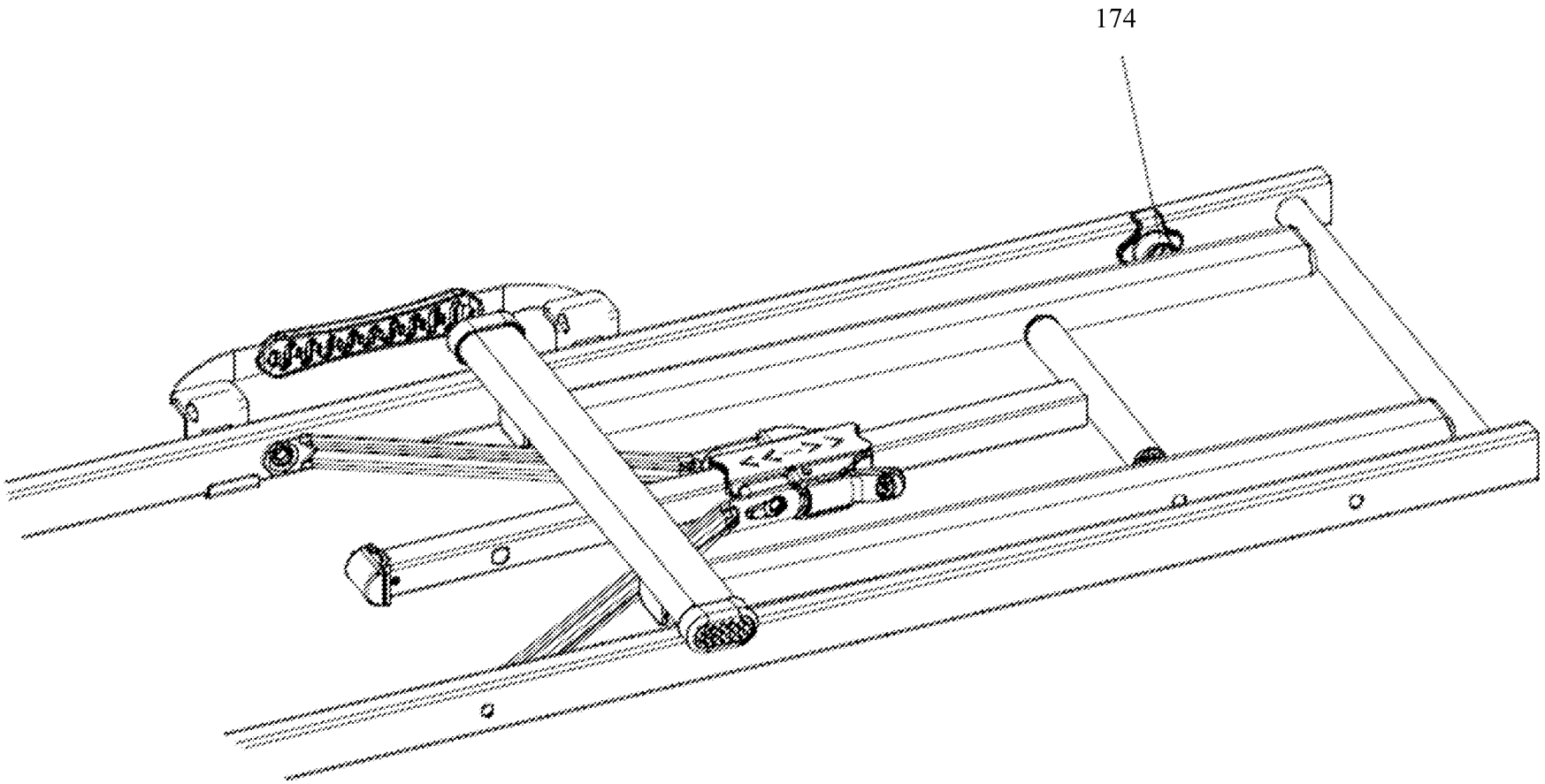
FIG. 4B is an enlarged view illustrating another portion of the foldable frame of FIG. 3.
Figure 5:
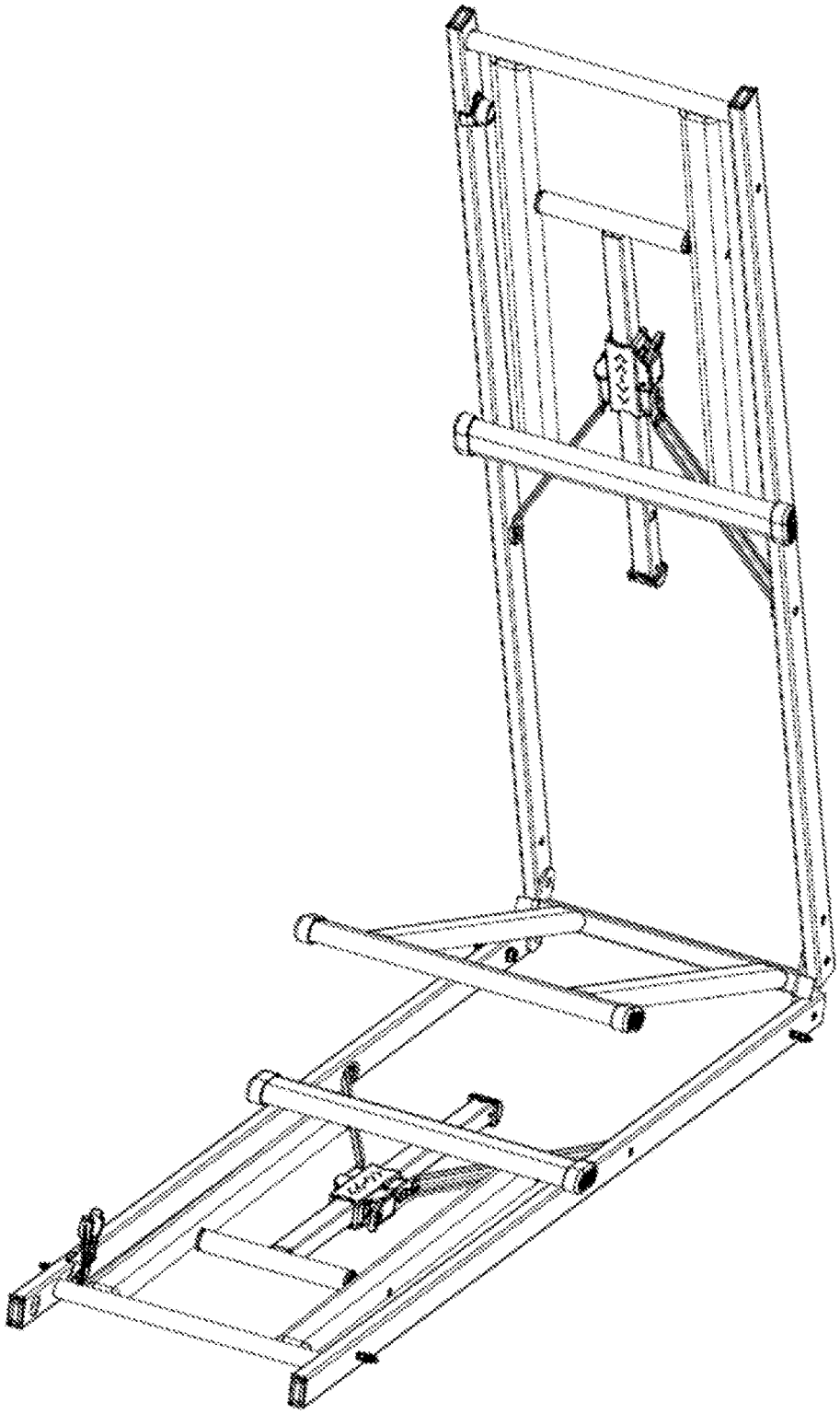
FIG. 5 is a perspective view schematically illustrating the foldable frame of FIG. 1 in another intermediate folding state in accordance with exemplary embodiments of the present disclosure.

Similarly, base member 123 of second leg assembly 120*b* is disposed at an exterior side (e.g., the right side of FIG. 1) of a lower end portion of the at least one leg (e.g., legs 124 and 125) of the second leg assembly. As such, when the second leg assembly is folded, the second supporting assembly, along with the upper member and at least one leg of the second leg assembly, is disposed substantially in a plane defined by the second mounting assembly (e.g., by the first and second mounting members of the second mounting assembly) as illustrated in FIGS. 3 and 4B. In some exemplary embodiments, the first and second mounting members of the second mounting assembly, the second leg assembly except the base member, and the second supporting assembly are disposed in the same plane, thereby minimizing the thickness of the frame when it is folded.

In some exemplary embodiments, base member 143 of third leg assembly 140 is disposed at a lower side (e.g., the up side of FIG. 1) of a lower end portion of the at least one leg of the third leg assembly. When the foldable frame is folded, the base members of the first, second and third leg assemblies are disposed between the first or second mounting member of the first mounting assembly and the first or second mounting member of the second mounting assembly.

In some exemplary embodiments, upper members 121 of the first and second leg assemblies and upper member 141 of the third assembly are disposed substantially parallel to each other, with a distance "L1" between the upper members of the first and third leg assemblies and a distance "L2" between the upper members of the second and third leg assemblies. The distance "L1" is equal to or greater than the sum of the heights of the first and third leg assemblies and the distance "L2" is equal to or greater than the sum of the heights of the second and third leg assemblies such that the third leg assembly do not overlap with either the first or the second leg assembly when the frame is folded, thereby minimizing the thickness of the folded frame.

Figure 6:
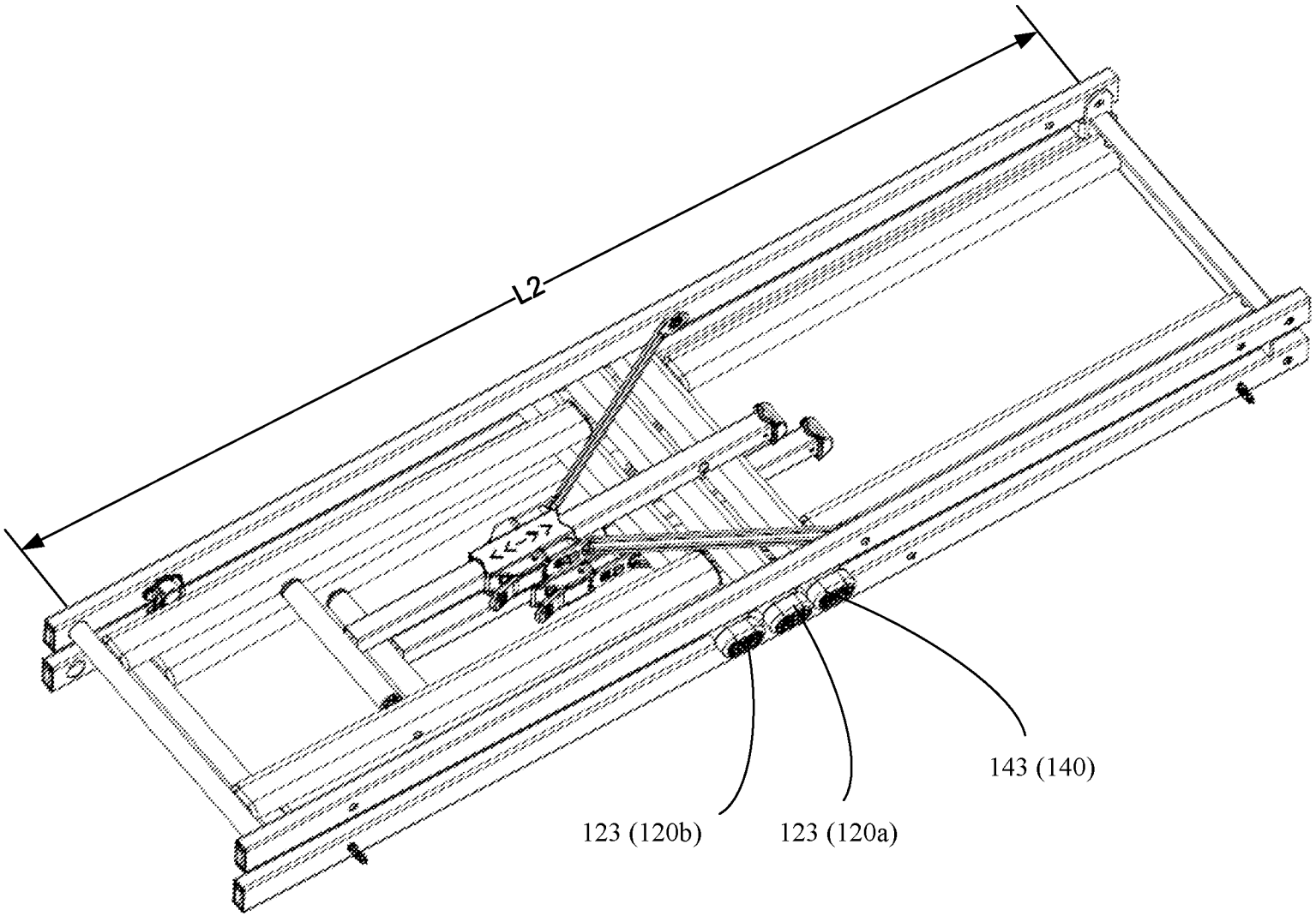
FIG. 6 is a perspective view schematically illustrating the foldable frame of FIG. 1 in a folded state in accordance with exemplary embodiments of the present disclosure.

In some exemplary embodiments, the distances "L1" and "L2" are different from each other such that when the frame is folded, the base members of the first, second and third leg assemblies are disposed side by side along a longitudinal direction of the frame (e.g., a length direction of the first or second mounting member of the first or second mounting assembly). For instance, in some exemplary embodiments, the distance "L2" is greater than the sum of the heights of the second and third leg assemblies such that when the frame is folded, there is a gap between the base members of the second and third assemblies. The distance "L1" is shorter than the distance "L2" such that the base member of the first leg assembly is disposed in the gap between the base members of the second and third assemblies. In other words, when the frame is folded, base member 123 of first leg assembly 120*a* is disposed between base member 123 of second assembly 120*b* and base member 143 of third assembly 140 along the longitudinal direction of the frame, as illustrated in FIG. 6.

The foldable frame can include other additional, optional or alternative features. For instance, in some embodiments, the foldable frame includes a buckle structure or the like to prevent accidental unfolding of the foldable frame. In some exemplary embodiments, a buckle structure includes a third coupler and a fourth coupler, one disposed at the first mounting assembly and the other disposed at the second mounting assembly. As a non-limiting example, FIGS. 3, 4A and 4B illustrate coupler 172 disposed at the first mounting member of the first mounting assembly and coupler 174 disposed at the first mounting member of the second mounting assembly. It should be noted that coupler 172 can be disposed at the first mounting member of the second mounting assembly and coupler 174 can be disposed at the first mounting member of the first mounting assembly. It should also be noted that coupler 172 and coupler 174 can be disposed at the second mounting members of the first and second mounting assemblies. In an exemplary embodiment, coupler 172 includes a pair of arms 173 that couples (e.g., clips, holds, catches, clasps, hooks or the like) with a column of coupler 174, and thus retain the foldable frame in the folded state.

Figure 7:
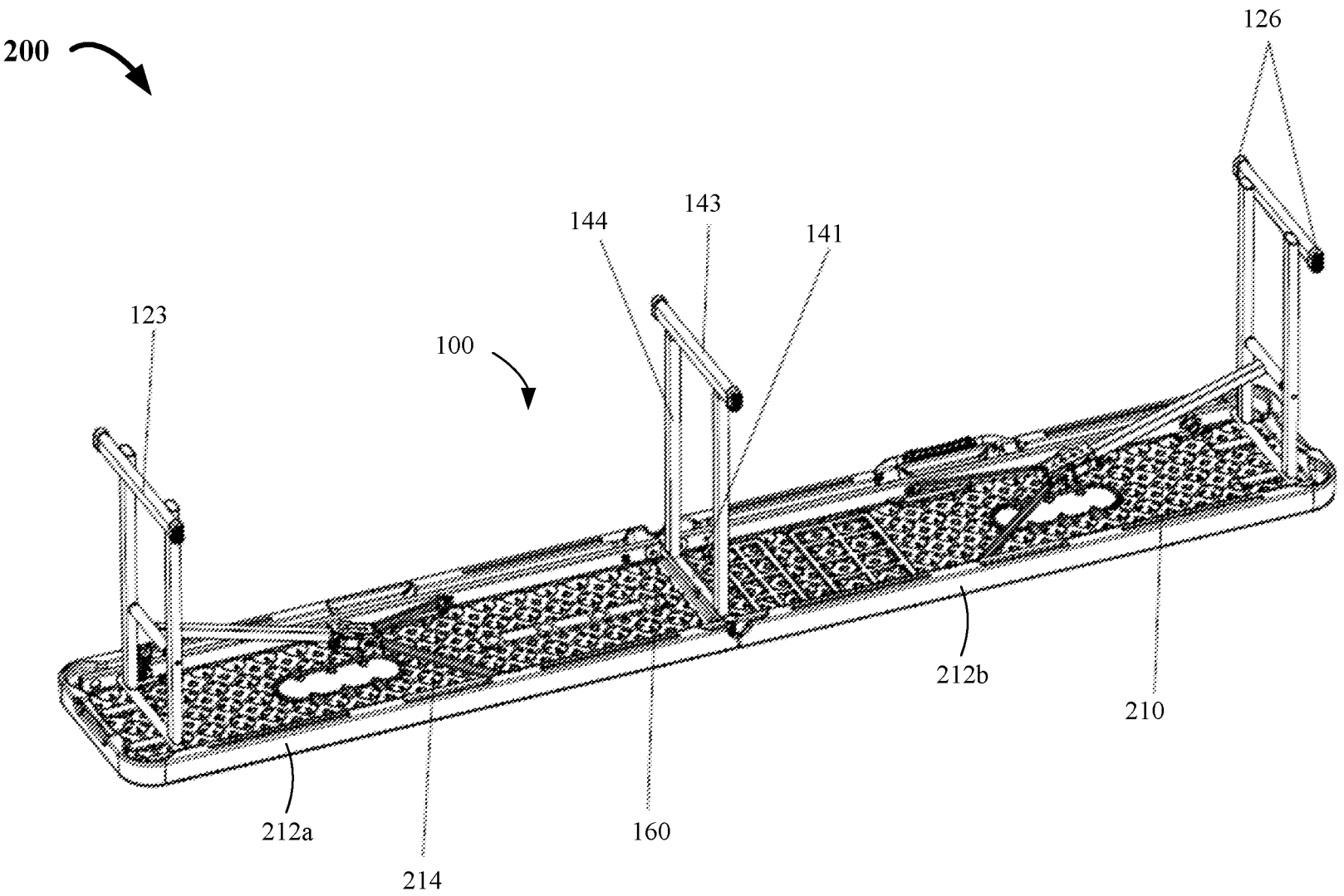
FIG. 7 is a bottom perspective view schematically illustrating an exemplary foldable table in an unfolded state in accordance with exemplary embodiments of the present disclosure.
Figure 8A:
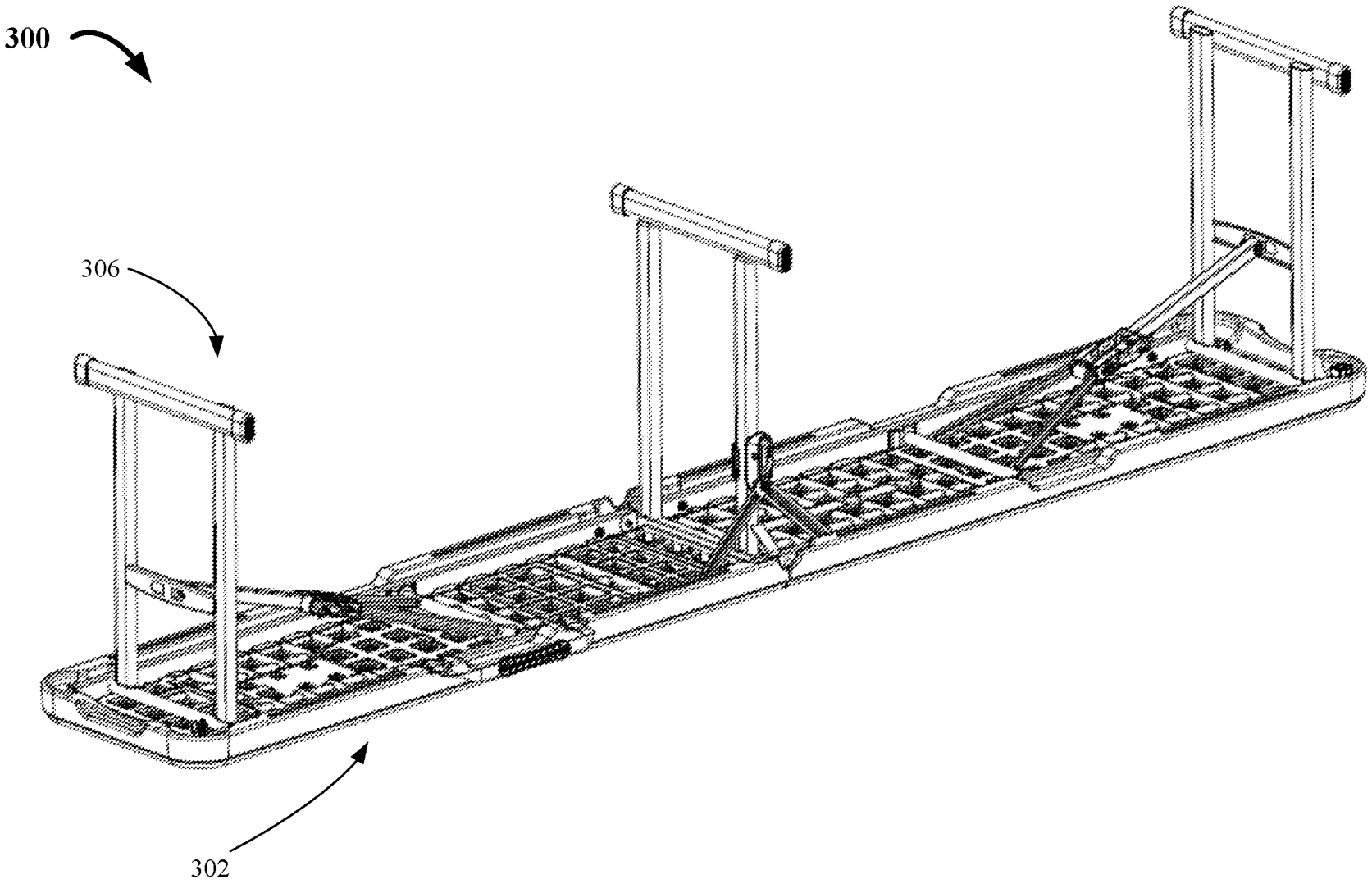
FIG. 8A is a bottom perspective view schematically illustrating an exemplary foldable structure in an unfolded state in accordance with exemplary embodiments of the present disclosure.
Figure 8B:
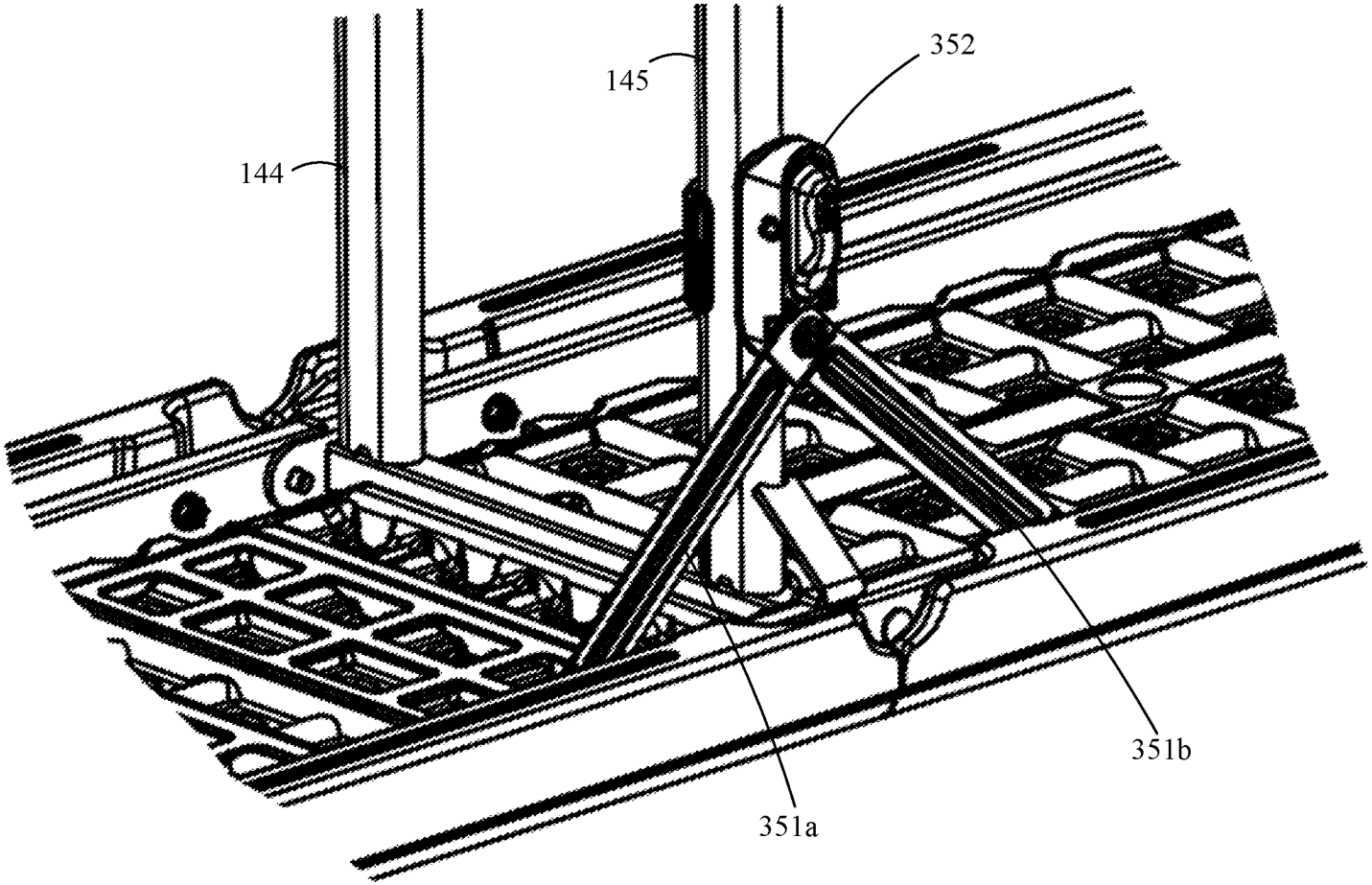
FIG. 8B is an enlarged view schematically illustrating a portion of the exemplary foldable structure of FIG. 8A.
Figure 9A:
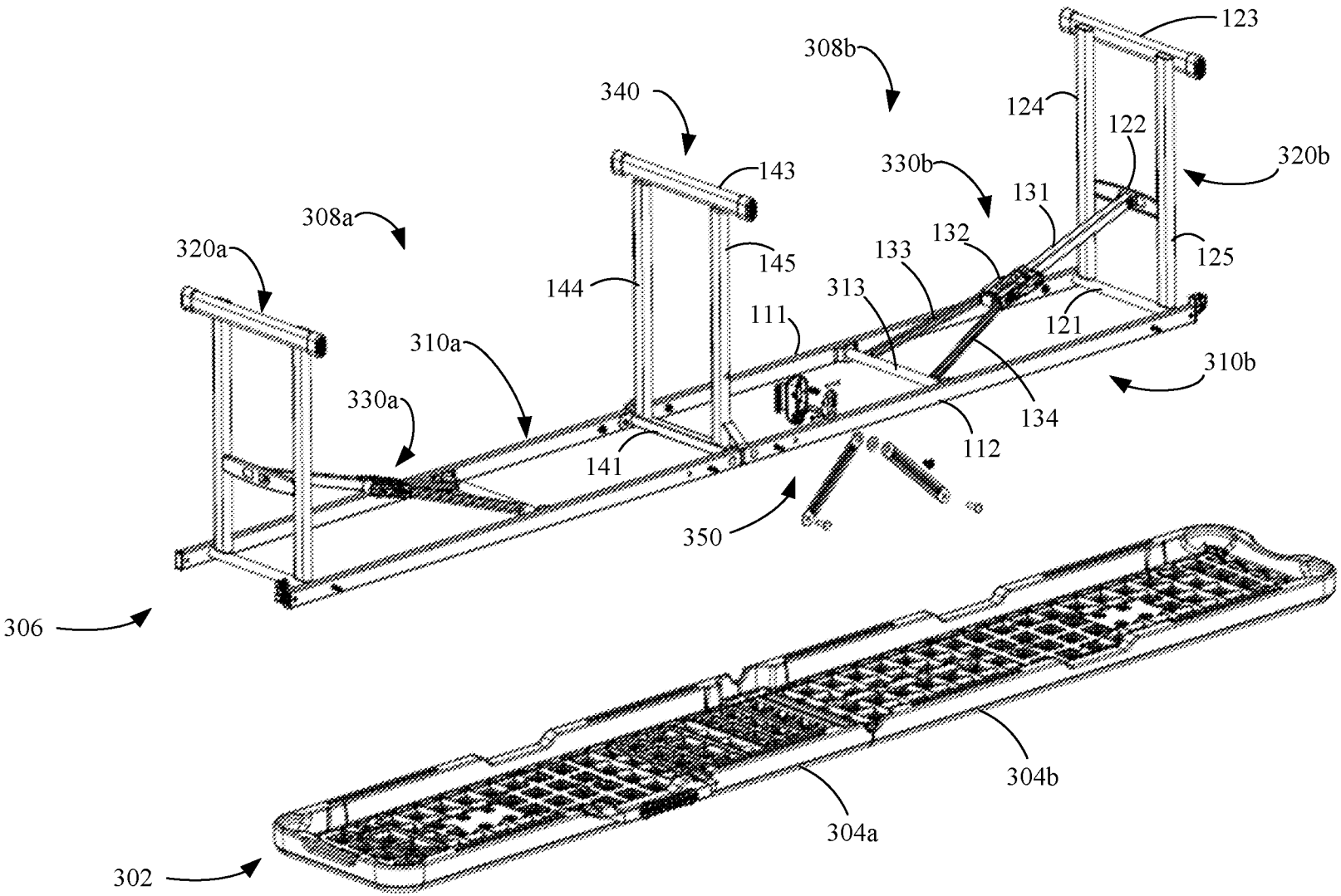
FIG. 9A is an exploded view schematically illustrating the exemplary foldable structure of FIG. 8A.
Figure 9B:
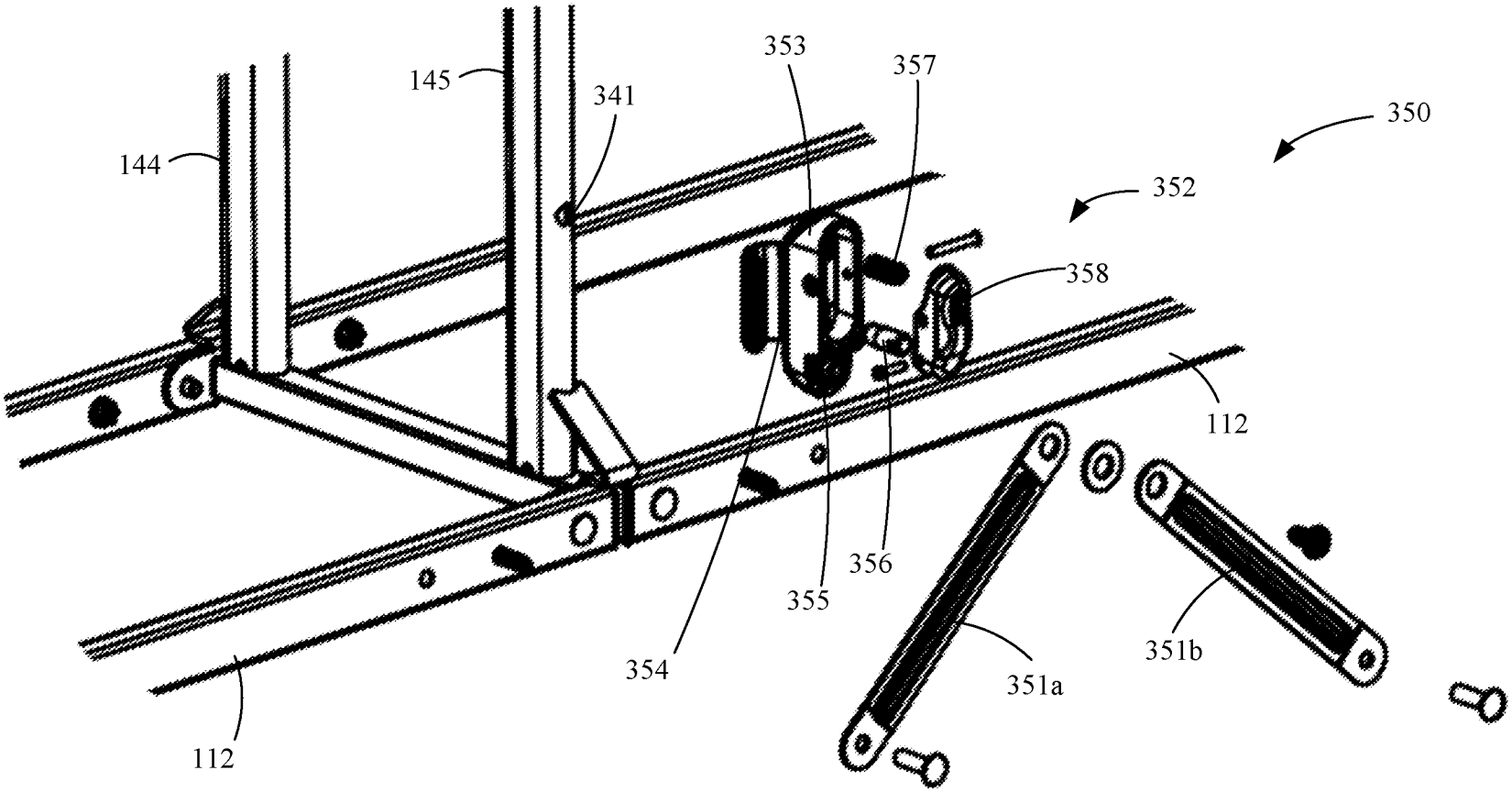
FIG. 9B is an enlarged view schematically illustrating a portion of the exemplary foldable structure of FIG. 9A.
Figure 10A:
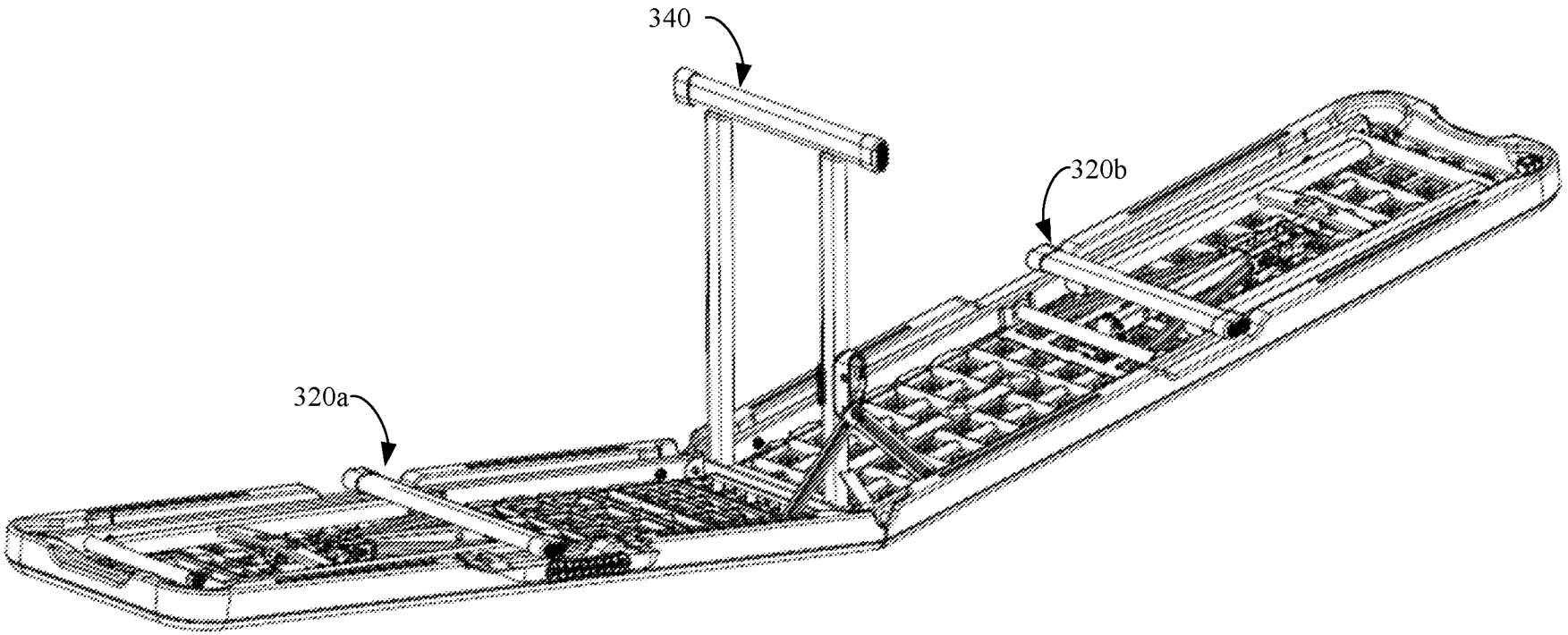
FIG. 10A is a bottom perspective view schematically illustrating the exemplary foldable structure of FIG. 8A in an intermediate state.
Figure 10B:
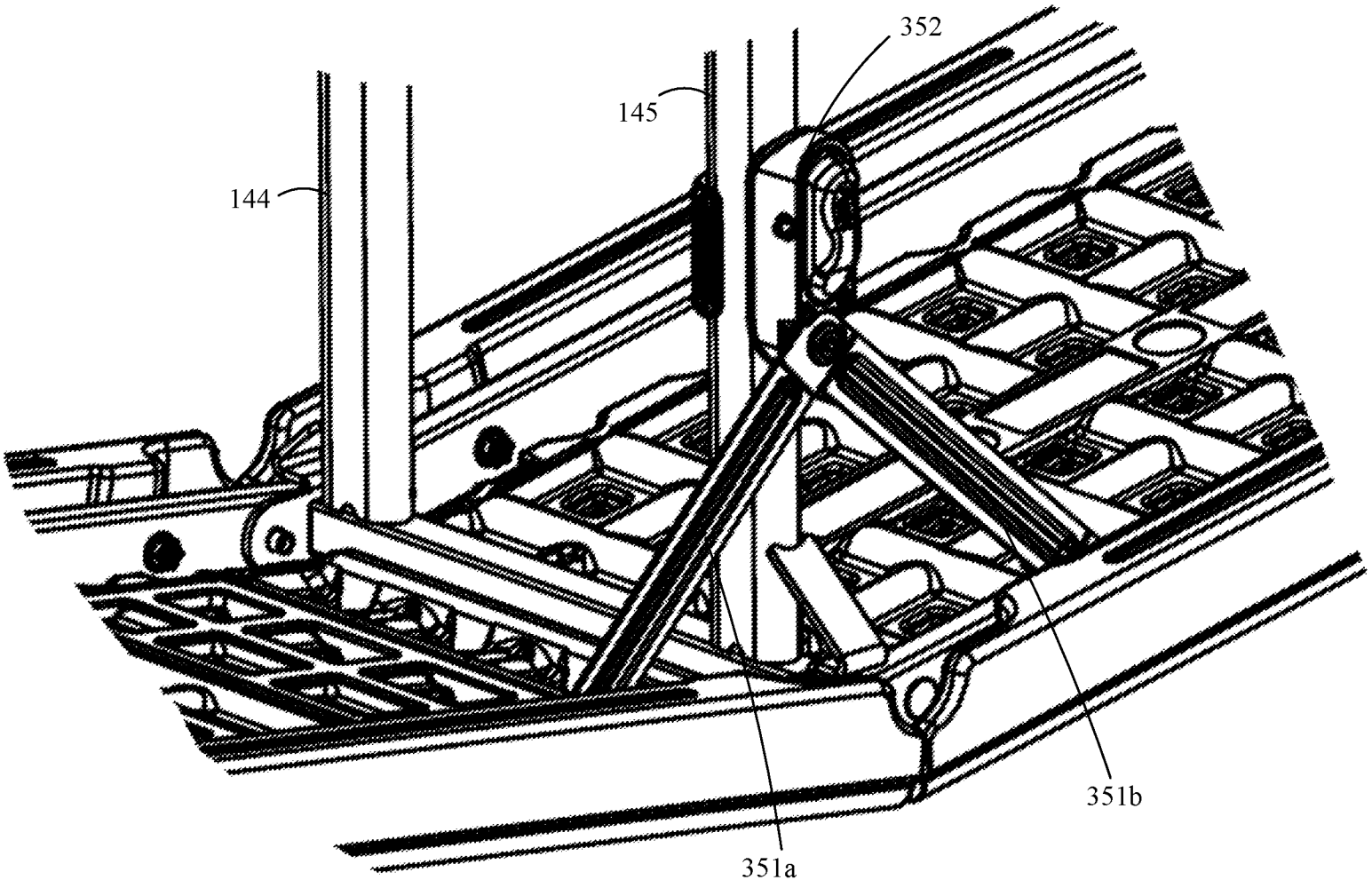
FIG. 10B is an enlarged view schematically illustrating a portion of the exemplary foldable structure of FIG. 10A.
Figure 11A:
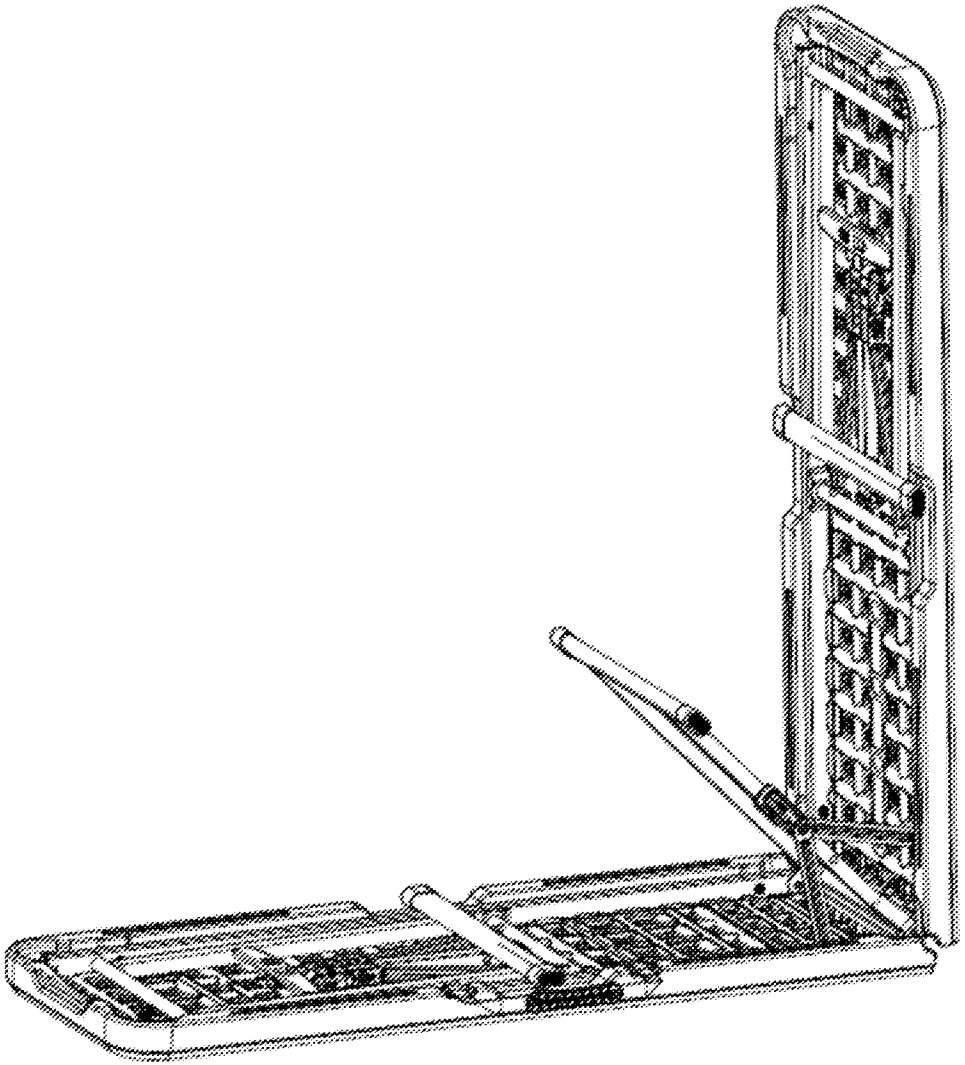
FIG. 11A is a bottom perspective view schematically illustrating the exemplary foldable structure of FIG. 8A in another intermediate state.
Figure 11B:
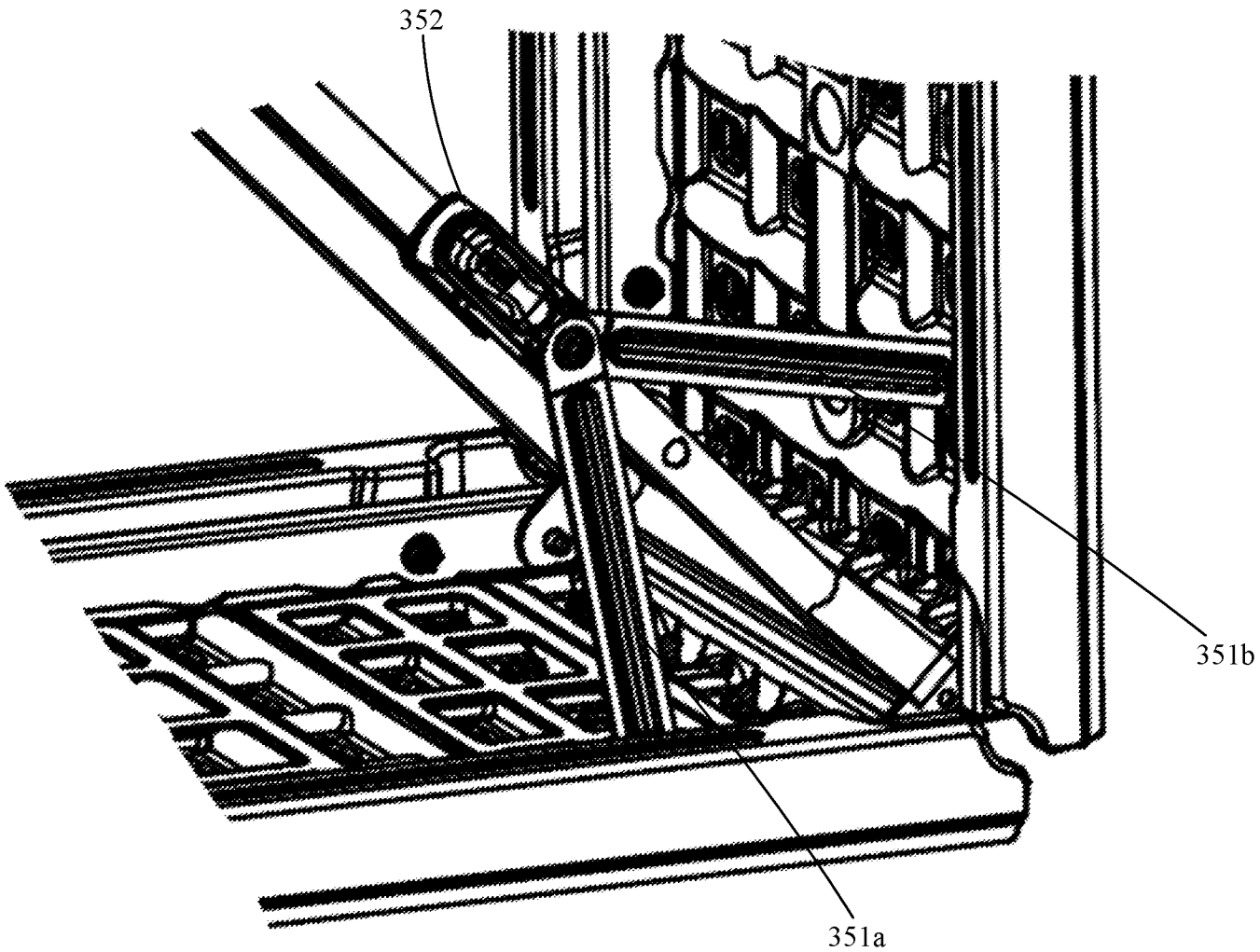
FIG. 11B is an enlarged view schematically illustrating a portion of the exemplary foldable structure of FIG. 11A.
Figure 12A:
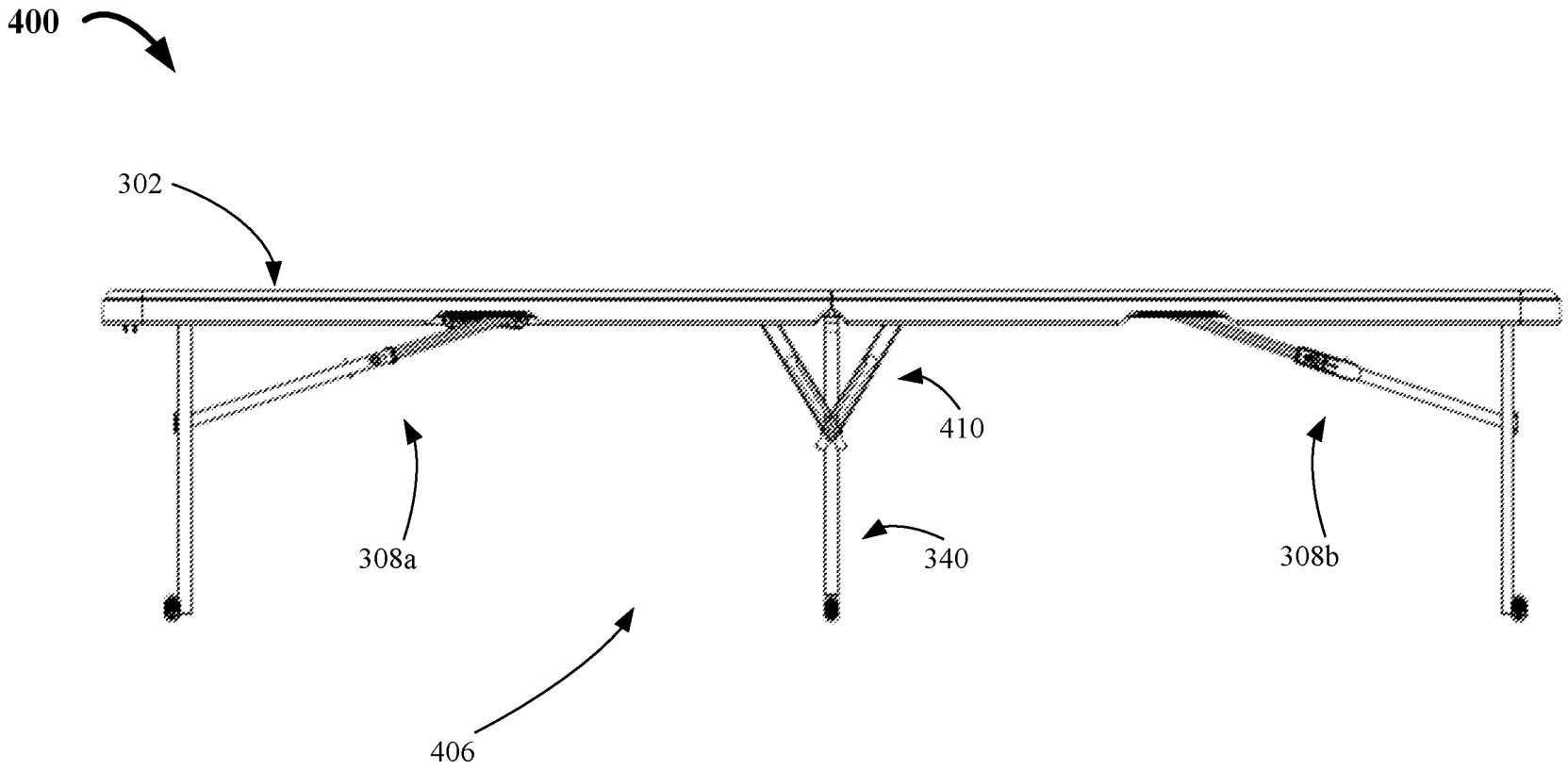
FIG. 12A is a side view schematically illustrating an exemplary foldable structure in an unfolded state in accordance with exemplary embodiments of the present disclosure.
Figure 12B:
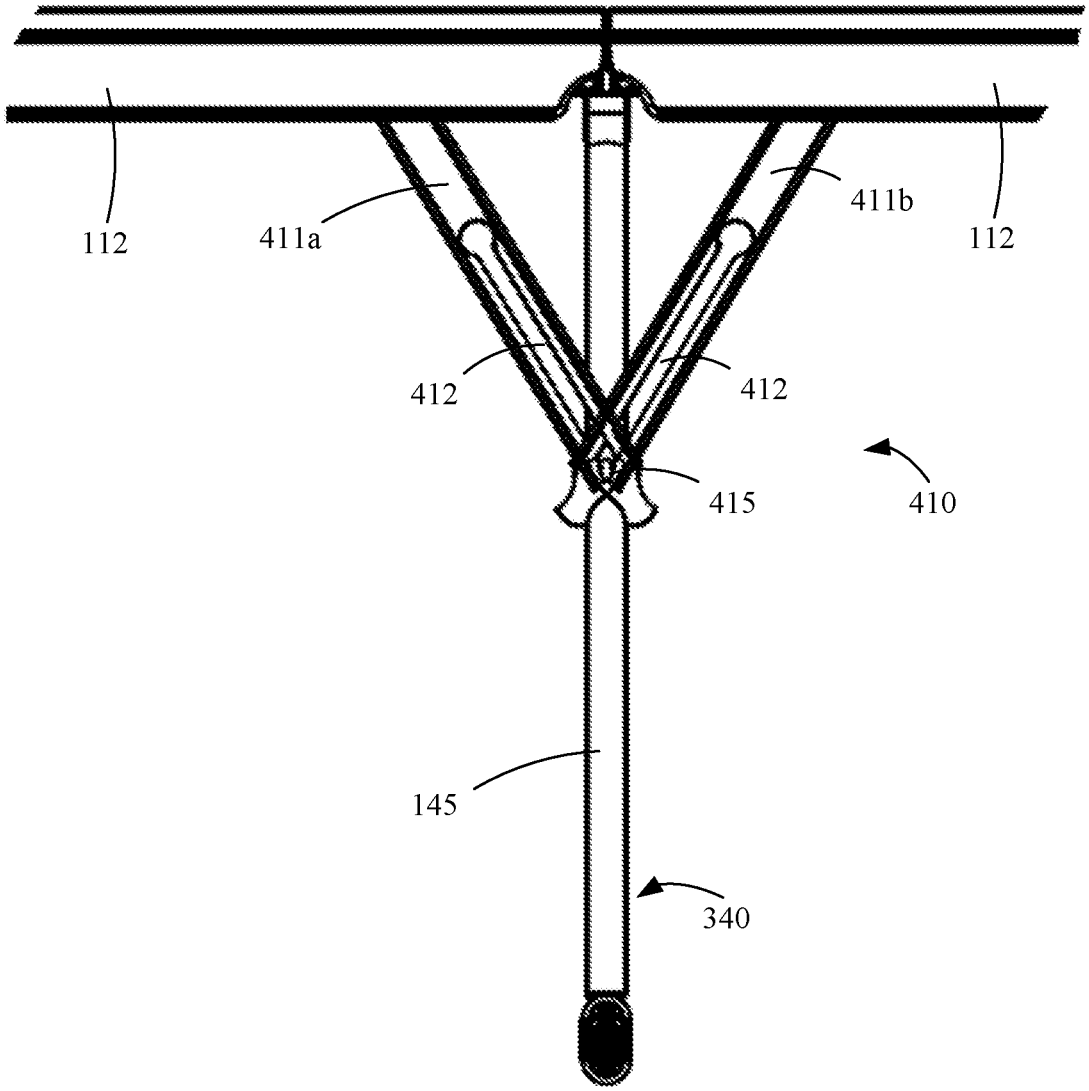
FIG. 12B is an enlarged view schematically illustrating a portion of the exemplary foldable structure of FIG. 12A.
Figure 13A:
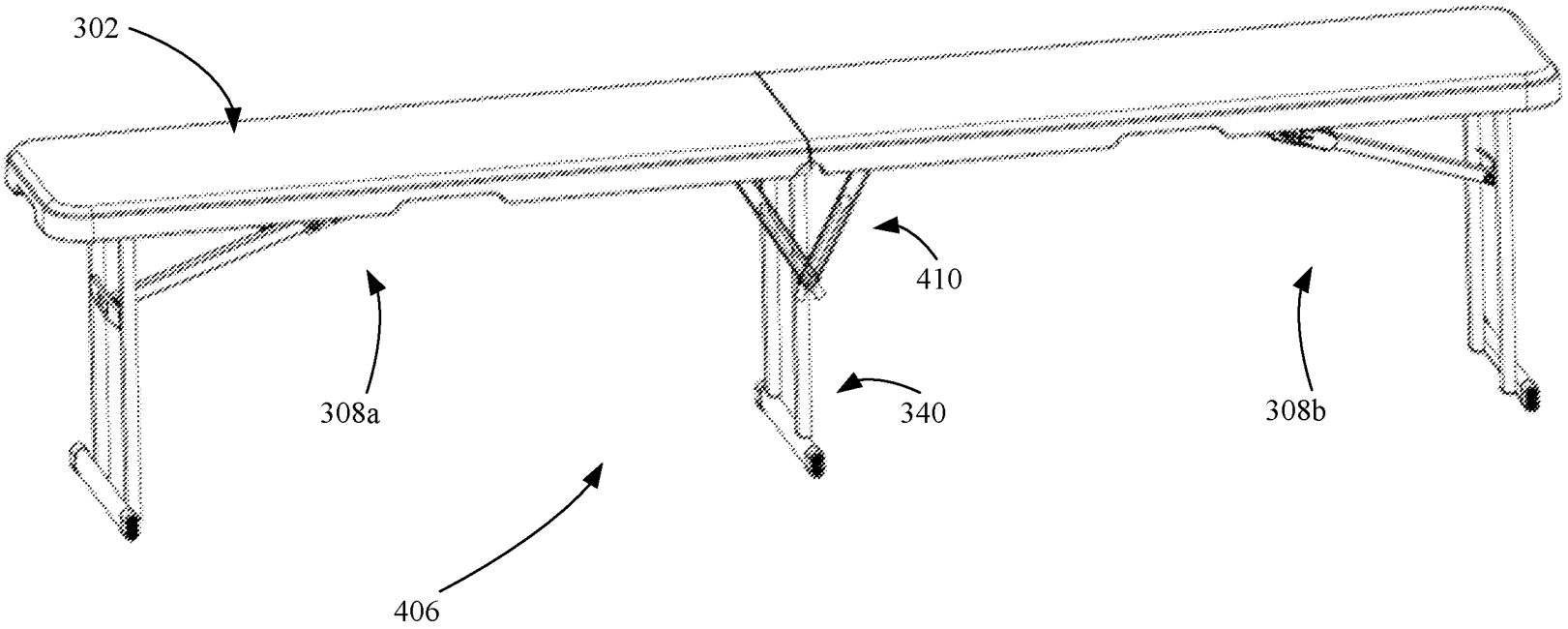
FIG. 13A is a top perspective view schematically illustrating the exemplary foldable structure of FIG. 12A.
Figure 13B:
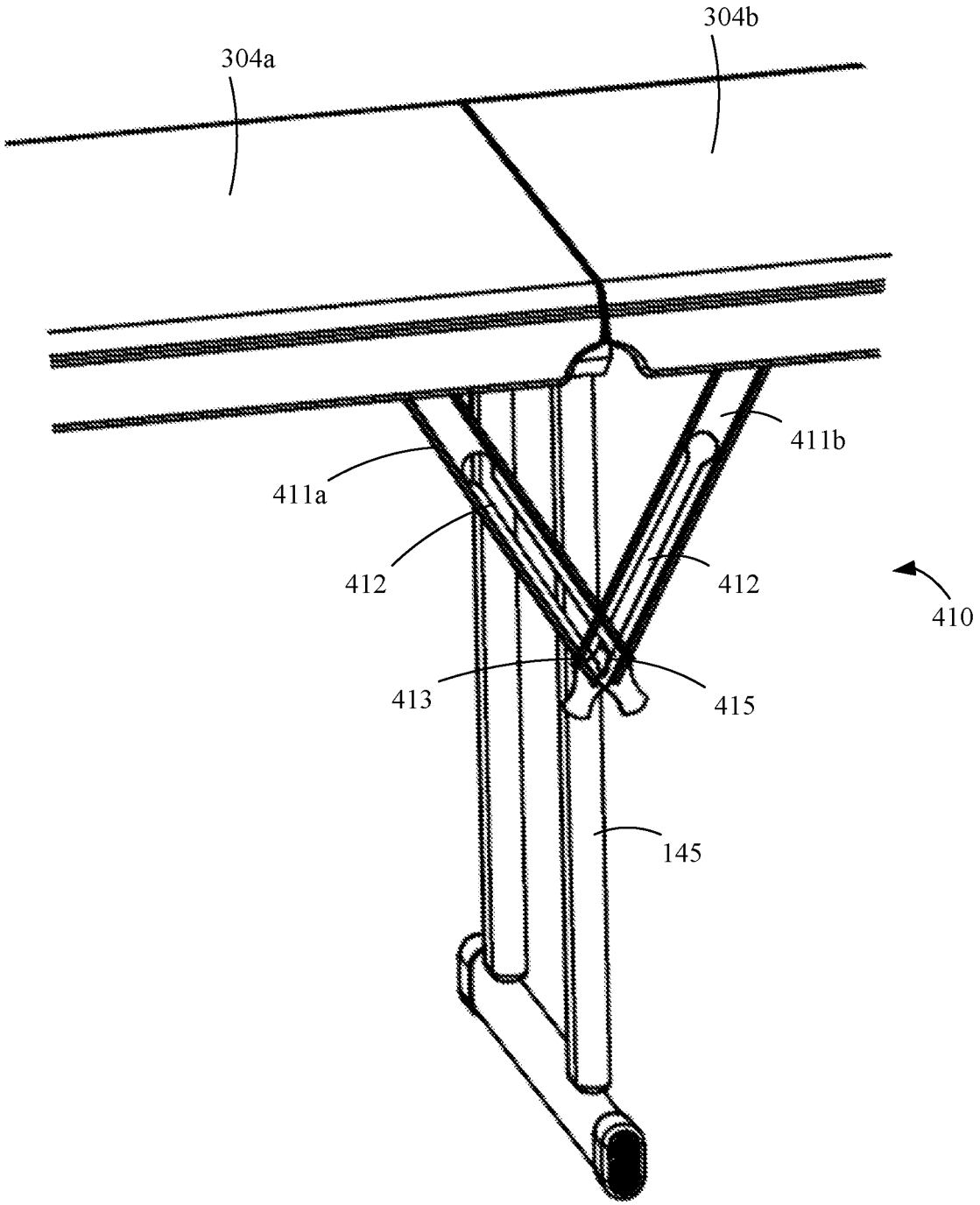
FIG. 13B is an enlarged view schematically illustrating a portion of the exemplary foldable structure of FIG. 13A.
Figure 14A:
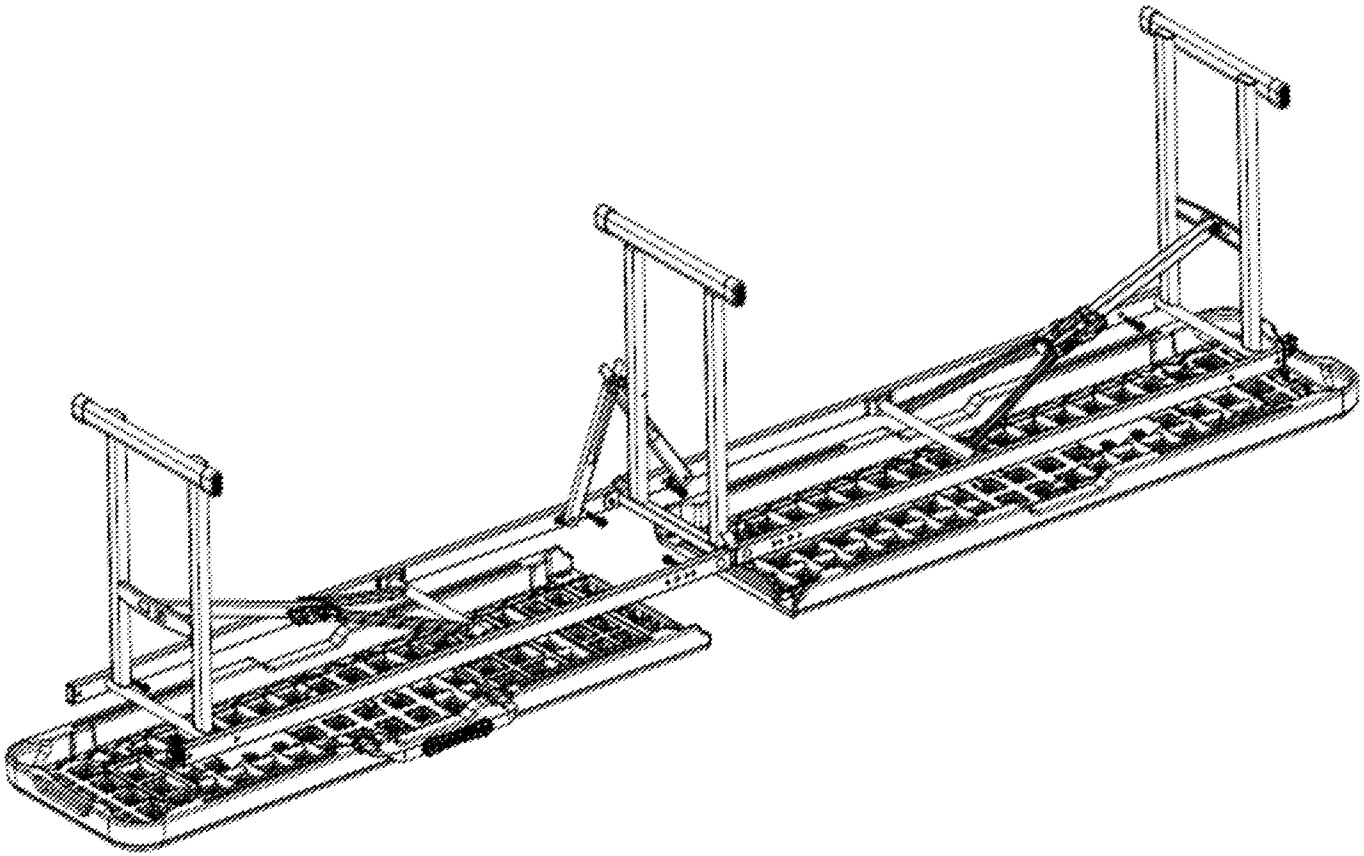
FIG. 14A is an exploded view schematically illustrating the exemplary foldable structure of FIG. 12A in an intermediate state.
Figure 14B:
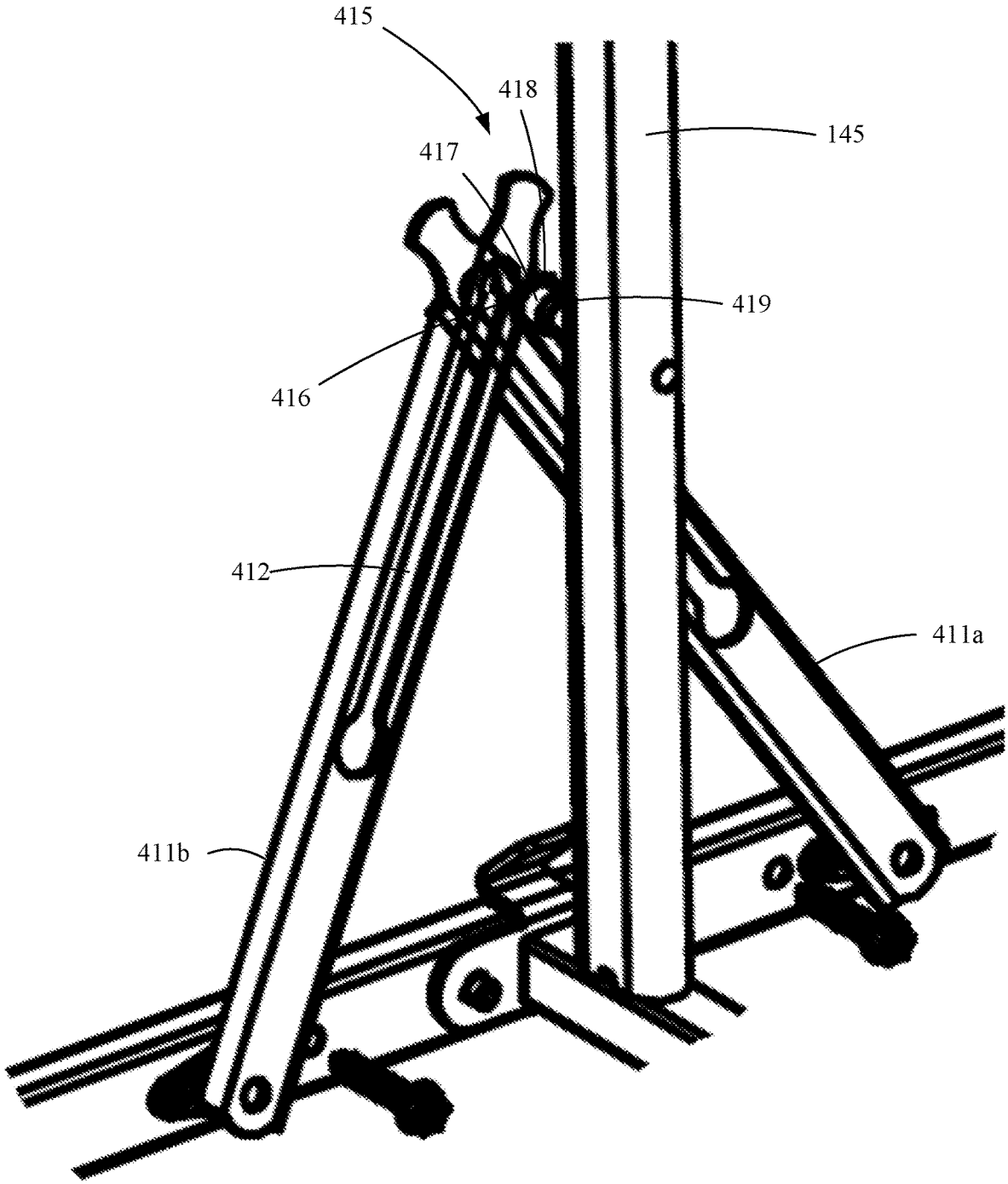
FIG. 14B is an enlarged view schematically illustrating a portion of the exemplary foldable structure of FIG. 14A.
Figure 15A:
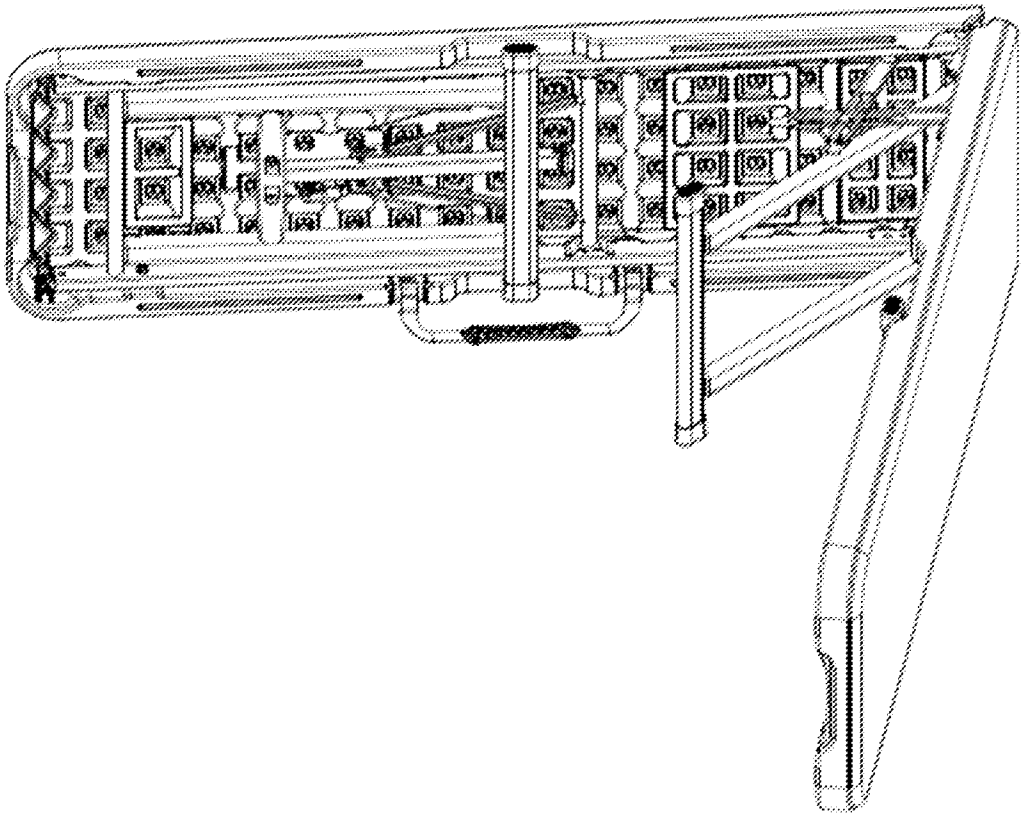
FIG. 15A is a perspective view schematically illustrating the exemplary foldable structure of FIG. 12A in an intermediate state.
Figure 15B:
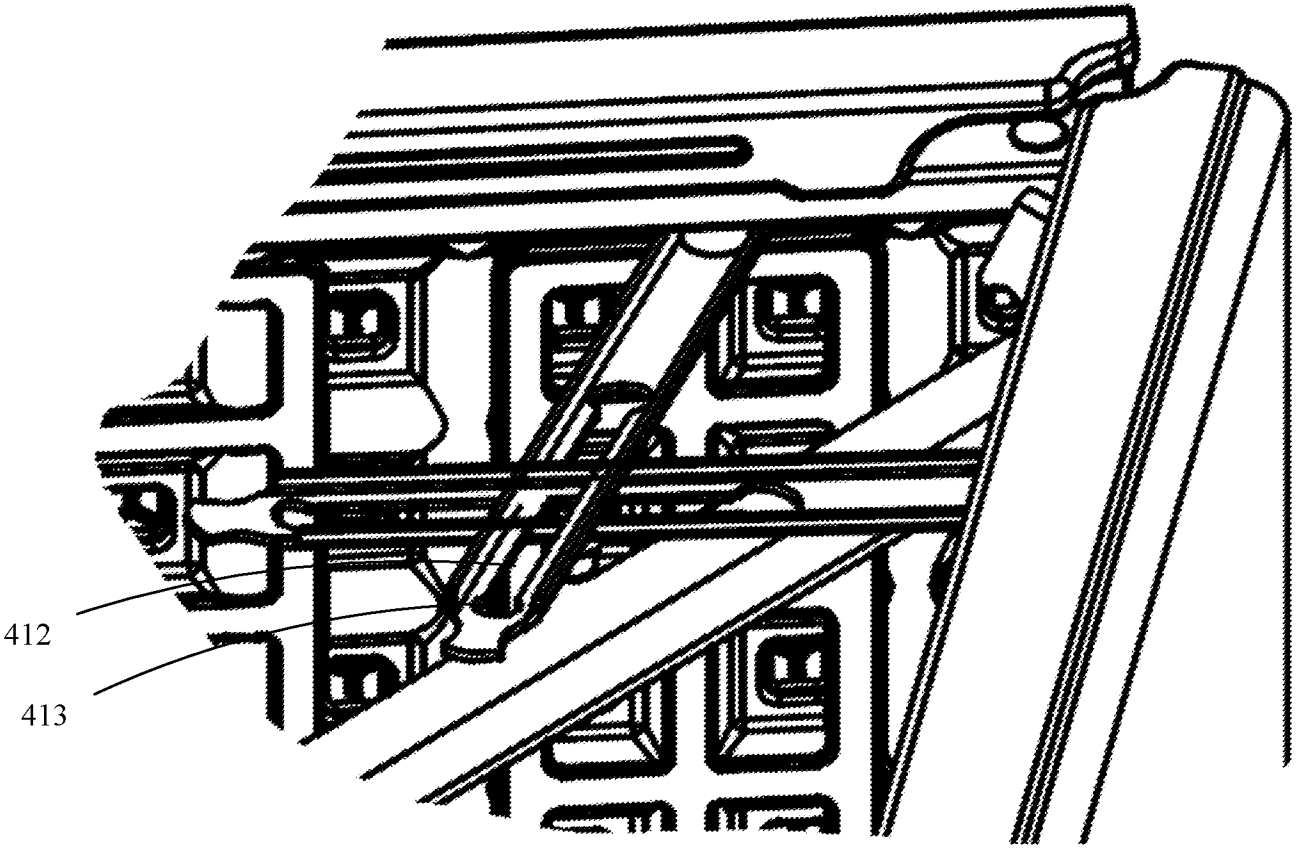
FIG. 15B is an enlarged view schematically illustrating a portion of the exemplary foldable structure of FIG. 15A.

The frames of the present disclosure can be used to make benches, tables, beds or the like. For instance, as a non-limiting example, FIG. 7 illustrates an exemplary table 200 including a table panel 210 coupled with and supported by a frame of the present disclosure. In some exemplary embodiments, the table panel includes a first panel unit 212*a* coupled with the first mounting assembly and a second panel unit 212*b* coupled with the second mounting assembly, making the table foldable in half. Each of the first and second panel unit includes a lip such as lip 214 extending downward. The table panel can be of blow-molded plastic board, wood board or the like. One or more components (e.g., mounting members, supporting members, etc.) of the frame can be of a hollow tube structure to reduce the weight of the foldable frame and the furniture using the frame. The frames and the furniture made of the frames of the present disclosure are easy to use, convenient to carry around and stable in use.

Referring to FIGS. 8A-11B, there is depicted an exemplary structure 300 in accordance with some exemplary embodiments of the present invention. Structure 300 can be a bench, a table, a bed, or the like. Structure 300 generally includes a panel, such as panel 302, and a foldable frame, such as frame 306, to support the panel. Like panel 210, panel 302 can be of blow-molded plastic board, wood board or the like. In some exemplary embodiments, panel 302 includes a first panel unit, such as panel unit 304*a*, and a second panel unit, such as panel unit 304*b*. In some exemplary embodiments, panel units 304*a*, 304*b* are the same as or similar to panel units 212*a*, 212*b* disclosed herein.

Frame 306 includes a first mounting assembly, such as first mounting assembly 310*a*, and a second mounting assembly, such as second mounting assembly 310*b*. First and second mounting assemblies 310*a*, 310*b* can be configured the same as, similarly to, or differently from first and second mounting assemblies 110*a*, 110*b*. For instance, in some exemplary embodiments, like first and second mounting assemblies 110*a*, 110*b*, each of first and second mounting assemblies 310*a*, 310*b* includes first mounting member 111 and second mounting member 112. The proximal end portions of the first mounting members of the two mounting assemblies are pivotally coupled with each other, for instance, by a first coupler (e.g., coupler 160 at the upper side of FIG. 1). The proximal end portions of the second mounting members of the two mounting assemblies are pivotally coupled with each other, for instance, by a second coupler (e.g., coupler 160 at the lower side of FIG. 1). In some exemplary embodiments, first mounting assembly 310*a* or second mounting assembly 310*b* includes additional or optional components. For instance, as a non-limiting example, it is illustrated that each of first and second mounting assemblies 310*a*, 310*b* includes a lateral mounting member 313 having one end portion connected to the first mounting member and another end portion connected to the second mounting member.

Like frame 100, frame 306 also includes two or more leg assemblies. For instance, in some exemplary embodiments, frame 306 includes three leg assemblies, which can be configured the same as or differently from each other. By way of example, frame 306 is illustrated with first leg assembly 320*a*, second leg assembly 320*b* and third leg assembly 340. As used herein, a third leg assembly (e.g., third leg assembly 140 or 340) is also termed as a middle leg assembly. However, it should be noted that the term "middle" as used herein does not necessarily mean the center of the frame, and the term "side" does not necessarily mean an outmost edge of the frame.

In some exemplary embodiments, first leg assembly 320*a* is configured substantially the same as first leg assembly 120*a*, second leg assembly 320*b* is configured substantially the same as second leg assembly 120*b*, and/or third (middle) leg assembly 340 is configured substantially the same as third leg assembly 140. For instance, in some exemplary embodiments, first leg assembly 320*a* or second leg assembly 320*b* includes an upper member such as upper member 121, one or more legs such as first leg 124 and second leg 125, an intermediate member such as intermediate member 122, a base member such as base member 123, or any combination thereof. In some exemplary embodiments, third leg assembly 340 includes an upper member such as upper member 141, one or more legs such as first leg 144 and second leg 145, a base member such as base member 143, or any combination thereof. However, the present invention is not limited thereto. First leg assembly 320*a* can be configured the same as, similarly to or differently from first leg assembly 120*a*. Similarly, second leg assembly 320*b* can be configured the same as, similarly to or differently from second leg assembly 120*b*, and third (middle) leg assembly 340 can be configured the same as, similarly to or differently from third leg assembly 140.

First leg assembly 320*a* is pivotally coupled with first mounting assembly 310*a*, and second leg assembly 320*b* is pivotally coupled with second mounting assembly 310*b*. For instance, in some exemplary embodiments, first leg assembly 320*a* or second leg assembly 320*b* includes an upper member such as upper member 121 having a first end portion pivotally coupled with first mounting member 111 of the first or second mounting assembly and a second end portion pivotally coupled with second mounting member 112 of the first or second mounting assembly. In some exemplary embodiments, first leg assembly 320*a* or second leg assembly 320*b* also includes one or more legs such as first leg 124 and second leg 125. Each of the first and second legs has an upper end portion connected or formed with the upper member of the first or second leg assembly. In some exemplary embodiments, first leg assembly 320*a* or second leg assembly 320*b* further includes an intermediate member such as intermediate member 122 disposed between the first and second legs. The intermediate member has a first end portion connected or formed with the first leg and a second end portion connected or formed with the second leg of the first or second leg assembly. In some exemplary embodiments, first leg assembly 320*a* or second leg assembly 320*b* further includes a base member such as base member 123, with which lower end portions of the first and second legs are connected or formed.

Third (middle) leg assembly 340 is coupled with both of first mounting assembly 310*a* and second mounting assembly 310*b* at the proximal sides of the first and second mounting assemblies. For instance, in some exemplary embodiments, third (middle) leg assembly 340 includes an upper member such as upper member 141 having a first end portion coupled with the first coupler (e.g., coupler 160 at the upper side of FIG. 1) and a second end portion coupled with the second coupler (e.g., coupler 160 at the lower side of FIG. 1). In some exemplary embodiments, third leg assembly 340 also includes one or more legs such as first leg 144 and second leg 145, each having an upper end portion connected to or formed with the upper member of the third leg assembly. In some exemplary embodiments, third leg assembly 340 further includes a base member such as base member 143, with which lower end portions of the first and second legs are connected or formed.

Similar to frame 100, in some exemplary embodiments, frame 306 includes one or more supporting assemblies, each configured to control rotation of a leg assembly, to stabilize a leg assembly when unfolded, or to help support one or more mounting assemblies. For instance, in some exemplary embodiments, frame 306 includes first and second supporting assemblies, such as first supporting assembly 330*a* and second supporting assembly 330*b*. In some exemplary embodiments, first supporting assembly 330*a* and second supporting assembly 330*b* are configured substantially the same as first supporting assembly 130*a* and second supporting assembly 130*b*. For instance, in some exemplary embodiments, first supporting assembly 330*a* or second supporting assembly 330*b* includes a first supporting member such as first supporting member 131, a controller such as controller 132, a second supporting member such as second supporting member 133 and a third supporting member such as third supporting member 134.

First supporting assembly 330*a* is pivotally coupled with first leg assembly 320*a* and first mounting assembly 310*a*. In some exemplary embodiments, first supporting assembly

330*a* is pivotally coupled with intermediate supporting member 122 of first leg assembly 320*a* and lateral mounting member 313 of first mounting assembly 310*a*. First supporting assembly 330*a* is configured to control the rotation of first leg assembly 320*a* with respect to first mounting assembly 310*a*, and when the frame is unfolded, to stabilize first leg assembly 320*a* and help support first mounting assembly 310*a*.

Similarly, second supporting assembly 330*b* is pivotally coupled with second leg assembly 320*b* and second mounting assembly 310*b*. In some exemplary embodiments, second supporting assembly 330*b* is pivotally coupled with intermediate supporting member 122 of second leg assembly 320*b* and lateral mounting member 313 of second mounting assembly 310*b*. Second supporting assembly 330*b* is configured to control the rotation of second leg assembly 320*b* with respect to second mounting assembly 310*b*, and when the frame is unfolded, to stabilize second leg assembly 320*b* and help support second mounting assembly 310*b*.

In some exemplary embodiments, the first mounting assembly, first leg assembly and/or first supporting assembly is collectively referred herein as a first unit, generally designated 308*a*. Similarly, the second mounting assembly, second leg assembly and/or second supporting assembly is collectively referred herein as a second unit, generally designated by 308*b*. The first and second units are pivotally coupled with each other at their proximal sides.

In some exemplary embodiments, frame 306 further includes a safety enhancement assembly, such as safety enhancement assembly 350, configured to prevent accidental folding of first frame unit 308*a* and second frame unit 308*b* when the frame is in use. Safety enhancement assembly 350 is also configured to help stabilize the frame, for instance, by providing support to first mounting assembly 310*a* and second mounting assembly 310*b*. Safety enhancement assembly 350 can be disposed at either side of the frame (i.e., either adjacent to first mounting members 111 or adjacent to second mounting member 112). In some exemplary embodiments, frame 306 include a single safety enhancement assembly. In some exemplary embodiments, frame 306 include a safety enhancement assembly on each side.

In some exemplary embodiments, safety enhancement assembly 350 includes a first enhancement member, such as first enhancement member 351*a*, a second enhancement member, such as second enhancement member 351*b*, and a locking mechanism, such as locking mechanism 352. Locking mechanism 352 is connected to the middle leg assembly. For instance, if the safety enhancement is disposed adjacent to first mounting members 111, the locking mechanism can be connected to first leg 144 of the middle leg assembly. If the safety enhancement is disposed adjacent to first mounting members 112, the locking mechanism can be connected to second leg 145 of the middle leg assembly. By way of example, it is illustrated that the locking mechanism can be connected to second leg 145 of the middle leg assembly.

First enhancement member 351*a* is connected to first frame unit 308*a* and locking mechanism 352, and second enhancement member 351*b* is connected to second frame unit 308*b* and locking mechanism 352. In some exemplary embodiments, first enhancement member 351*a* is pivotally connected to first frame unit 308*a* and locking mechanism 352, and second enhancement member 351*b* is pivotally connected to second frame unit 308*b* and locking mechanism 352. When first frame unit 308*a* and second frame unit 308*b* are in the unfolded state (e.g., the state illustrated in FIG. 8A), locking mechanism 352 selectively locks first enhancement member 351*a* and second enhancement member 351*b* so that they cannot move with respect to the first frame unit, second frame unit and middle leg assembly. As a result, it prevents accidental folding of the first and second frame units, which could pinch users' hands or cause other injury to users, and thus improves the stability and safety of the frame and the structure supported by the frame.

In some exemplary embodiments, locking mechanism 352 includes a sliding member, such as sliding member 353, that is coupled with the middle leg assembly and movable along a height direction of the middle leg assembly. For instance, in some exemplary embodiments, sliding member 353 includes or is formed with a slot, such as slot 354, that is slidably engaged with a leg (e.g., first leg 144 or second leg 145) of the middle leg assembly. In some exemplary embodiments, sliding member 353 includes or is formed with a connecting shaft, such as connecting shaft 355, configured for pivotally connecting the first and second enhancement members with the sliding member.

In some exemplary embodiments, first enhancement member 351*a* has one end portion pivotally connected to first frame unit 308*a* (e.g., mounting member 111 or 112 of first frame unit 308*a*) and another end portion pivotally connected to sliding member 353 (e.g., connecting shaft 355 of sliding member 353). Similarly, second enhancement member 351*b* has one end portion pivotally connected to second frame unit 308*b* (e.g., mounting member 111 or 112 of second frame unit 308*b*) and another end portion pivotally connected to sliding member 353 (e.g., connecting shaft 355 of sliding member 353).

Locking mechanism 352 is configured to selectively lock the first and second enhancement members when the first and second frame units are in the unfolded state, thereby preventing accidental folding of the first and second frame units. For instance, in some exemplary embodiments, locking mechanism 352 includes a fastening member, such as fasten member 356, configured to selectively lock the sliding member with the middle leg assembly and thus restricts the sliding member from moving along the height direction of the middle leg assembly (e.g., along the length of first leg 141 or second leg 142) when the first and second frame units are in the unfolded state. Since the first and second enhancement members is connected to the sliding member, this selectively locks the first and second enhancement members when the first and second frame units are in the unfolded state and thus prevents accidental folding of the first and second frame units.

In some exemplary embodiments, a restriction hole, such as restriction hole 341, is formed at middle leg assembly 340 (e.g., first leg 141 or second leg 142 of the middle leg assembly. In some such embodiments, fastening member 356 of the locking mechanism is a pin disposed in the sliding member and insertable into restriction hole 341.

In some exemplary embodiments, locking mechanism 352 includes an elastic member (e.g., a string), such as elastic member 357, and a pressing member, such as pressing member 358. The elastic member is disposed in the sliding member, and the pressing member is coupled with the sliding member. In some exemplary embodiments, the elastic member is encased in an enclosure formed by the sliding member and the press member. When the first and second frame units are in the unfolded state, the fastening member (e.g., the pin) is aligned with the restriction hole, and the elastic member (and in some cases via the pressing member) pushes the pin into the restriction hole. For instance, in some exemplary embodiments, a middle portion of the pressing member is connected to the sliding member so that the pressing member functions as a lever with one side coupled with the fastening member and the other side coupled with the elastic member. Under no external force, the elastic member, via the pressing member, pushes the pin into the restriction hole and thus restricts the movement of the sliding member with respect to the middle leg assembly. When folding is desired, the pressing member allows users to apply an external force on the elastic member to pull the fastening member out of the restriction hole. This unlocks the sliding member with respect to the middle leg assembly, and allows the sliding member to move along the height direction of the middle leg assembly to facilitate folding of the frame or structure.

Referring to FIGS. 12A-15B, there is depicted an exemplary structure 400 in accordance with some exemplary embodiments of the present invention. Structure 400 is similar to structure 300, except the safety enhancement assembly. For instance, like structure 300, structure 400 includes a panel, such as panel 302, and a foldable frame, such as frame 406. In some exemplary embodiments, frame 406 includes a first unit, such as first unit 308*a*, a second unit, such as second unit 308*b*, and a middle leg assembly, such as leg assembly 340.

In some exemplary embodiments, instead of safety enhancement assembly 350, frame 406 includes a safety enhancement assembly 410, to prevent accidental folding of first frame unit 308*a* and second frame unit 308*b* when the frame is in use. In some exemplary embodiments, safety enhancement assembly 410 includes a first enhancement member, such as first enhancement member 411*a*, a second enhancement member, such as second enhancement member 411*b*, and a locking mechanism, such as locking mechanism 415. Locking mechanism 415 is connected to the middle leg assembly, such as first leg 144 or second leg 145 of the middle leg assembly. First enhancement member 411*a* is connected to first frame unit 308*a* and locking mechanism 415, and second enhancement member 411*b* is connected to second frame unit 308*b* and locking mechanism 415. When first frame unit 308*a* and second frame unit 308*b* are in the unfolded state (e.g., the state illustrated in FIG. 13A), locking mechanism 415 selectively locks first enhancement member 411*a* and second enhancement member 411*b* so that they cannot move with respect to the first frame unit, second frame unit and middle leg assembly. As a result, it prevents accidental folding of the first and second frame units, which could pinch users' hands or cause other injury to users, and thus improves the stability and safety of the frame and the structure supported by the frame.

In some exemplary embodiments, locking mechanism 415 includes a fixation member 416 fixedly coupled with the middle leg assembly (e.g., fixedly coupled with first leg 144 or second leg 145 of the middle leg assembly). In some such embodiments, first enhancement member 411*a* is pivotally connected to first frame unit 308*a* (e.g., a mounting member of the first frame unit) and is coupled with fixation member 416 such that the fixation member is movable along a length direction of the first enhancement member. For instance, in some exemplary embodiments, first enhancement member 411*a* is formed with a first slot, such as slot 412, along at least a portion of the first enhancement member to receive fixation member 416 and to allow fixation member 416 to move along the slot. In some exemplary embodiments, first enhancement member 411*a* is also formed with a first restriction structure, such as restriction structure 413, to engage with the fixation member when the first frame unit is unfolded.

Similarly, second enhancement member 411*b* is pivotally connected to second frame unit 308*b* (e.g., a mounting member of the second frame unit) and is coupled with fixation member 416 such that the fixation member is movable along a length direction of the second enhancement member. For instance, in some exemplary embodiments, second enhancement member 411*b* is formed with a second slot, such as slot 412, along at least a portion of the second enhancement member to receive fixation member 416 and to allow fixation member 416 to move along the slot. In some exemplary embodiments, second enhancement member 411*b* is also formed with a second restriction structure, such as restriction structure 413, to engage with the fixation member when the second frame unit is unfolded.

Thus, when the first and second frame units are in the unfolded state, the fixation member of the locking mechanism (e.g., the limiting segment of the fixation member) selectively engages with the first restriction structure of the first enhancement member and the second restriction structure of the second enhancement member. This selectively locks the first and second enhancement members when the first and second frame units are in the unfolded state and thus prevents accidental folding of the first and second frame units.

In some exemplary embodiments, the first restriction structure is formed at an end of the first slot of the first enhancement member, e.g., connected to the first slot. In some exemplary embodiments, the first restriction structure is a hole with a diameter or width larger than the width of the first slot. Similarly, in some exemplary embodiments, the second restriction structure is formed at an end of the second slot of the second enhancement member, e.g., connected to the second slot. In some exemplary embodiments, the second restriction structure is a hole with a diameter or width larger than the width of the second slot.

In some exemplary embodiments, fixation member 416 includes multiple segments. For instance, in some exemplary embodiments, fixation member 416 includes a sliding segment 417 and a limiting segment 418, where a nominal diameter of the sliding segment is smaller than that of the limiting segment. The sliding segment is configured to be slidable along the first and second slots of the first and second enhancement members. The limiting segment is configured to be engageable with the first and second restriction structures of the first and second enhancement members when the first and second frame units are in the unfolded state.

In some exemplary embodiments, locking mechanism 415 includes an elastic member, such as elastic member 419. Elastic member 419 can be a string or the like. In some exemplary embodiments, elastic member 419 is sleeved on the fixation member and has one end abutting the middle leg assembly (e.g., abutting a leg of the middle leg assembly) and another end abutting the first enhancement member and/or the second enhancement member. This ensures that the first and second enhancement members abut the limiting segment of the fixation member while the sliding segment moves along the slots of the first and second enhancement members during the folding and unfolding of the frame. This also ensures that the limiting segment firmly engages with the restriction structures of the first and second enhancement members when the frame is unfolded, and thus locks the first and second enhancement members and prevents accidental folding of the first and second frame units.

When folding of the frame is desired, elastic member 419 allows the user to disengage the limiting segment of the fixation member from the restriction structures of the first and second enhancement members, for instance, by pressing the first and second enhancement members toward the middle leg assembly. Once it is disengaged, the frame can be folded by rotating the first and second units toward the middle leg assembly.

The terminology used herein is for the purpose of describing particular implementations only and is not intended to be limiting of the claims. As used in the description of the implementations and the appended claims, the singular forms "a" "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A foldable frame comprising:

a first frame unit and a second frame unit pivotally coupled with each other at proximal sides thereof and rotatable with respect to each other between a folded state and an unfolded state, wherein each of the first and second frame units comprises a first mounting member disposed at a first side of the foldable frame and a second mounting member disposed at a second side of the foldable frame;

a middle leg assembly coupled with the first and second frame units at the proximal sides of the first and second frame units, wherein the middle leg assembly comprises:

a third upper member having a first end portion coupled to a proximal end portion of the first mounting member of the first frame unit and a proximal end portion of the first mounting member of the second frame unit by a first coupler disposed at the first side of the foldable frame and a second end portion coupled to a proximal end portion of the second mounting member of the first frame unit and a proximal end portion of the second mounting member of the second frame unit by a second coupler disposed at the second side of the foldable frame;

a first middle leg disposed at the first side of the foldable frame and having an upper end portion connected to the third upper member adjacent the first end portion of the third upper member; and a second middle leg disposed at the second side of the foldable frame and having an upper end portion connected to the third upper member adjacent the second end portion of the third upper member; and a single safety enhancement assembly disposed at the first side of the foldable frame to prevent accidental folding of the first and second frame units, wherein the single safety enhancement assembly comprises:

a locking mechanism connected to the first middle leg of the middle leg assembly;

a first enhancement member connected to the first mounting member of the first frame unit and the locking mechanism; and a second enhancement member connected to the first mounting member of the second frame unit and the locking mechanism, wherein no additional enhancement member is disposed between the second middle leg of the middle leg assembly and the second mounting member of the first or second frame unit; and wherein the locking mechanism selectively locks the first and second enhancement members when the first and second frame units are in the unfolded state, thereby preventing accidental folding of the first and second frame units.

2. The foldable frame of claim 1, wherein:

the locking mechanism comprises a sliding member and a fastening member;

the first enhancement member has one end portion pivotally connected to the first mounting member of the first frame unit and another end portion pivotally connected to the sliding member;

the second enhancement member has one end portion pivotally connected to the first mounting member of the second frame unit and another end portion pivotally connected to the sliding member;

the sliding member is coupled with the first middle leg of the middle leg assembly and movable along the first middle leg of the middle leg assembly; and the fastening member selectively locks the sliding member with the first middle leg of the middle leg assembly to restrict the sliding member from moving along the first middle leg of the middle leg assembly when the first and second frame units are in the unfolded state, thereby selectively locking the first and second enhancement members when the first and second frame units are in the unfolded state and thus preventing accidental folding of the first and second frame units.

3. The foldable frame of claim 2, wherein:

the first middle leg of the middle leg assembly comprises a restriction hole; and the fastening member of the locking mechanism is a pin disposed in the sliding member and insertable into the restriction hole of the first middle leg.

4. The foldable frame of claim 3, wherein the locking mechanism further comprises an elastic member disposed in the sliding member to push the pin into the restriction hole when the pin is aligned with the restriction hole.

5. The foldable frame of claim 4, wherein the locking mechanism further comprises a pressing member coupled with the sliding member for applying an external force on the elastic member to pull the pin out of the restriction hole.

6. The foldable frame of claim 2, wherein the sliding member comprises a slot slidably engaged with the first middle leg of the middle leg assembly.

7. The foldable frame of claim 2, wherein the sliding member comprises a connecting shaft for pivotally connecting the first and second enhancement members.

8. The foldable frame of claim 1, wherein:

the locking mechanism comprises a fixation member fixedly coupled with the first middle leg of the middle leg assembly;

the first enhancement member is coupled with the fixation member such that the fixation member is movable along a length direction of the first enhancement member, wherein the first enhancement member comprises a first restriction structure;

the second enhancement member is coupled with the fixation member such that the fixation member is movable along a length direction of the second enhancement member, wherein the second enhancement member comprises a second restriction structure; and the fixation member of the locking mechanism selectively engages with the first restriction structure of the first enhancement member and the second restriction structure of the second enhancement member when the first and second frame units are in the unfolded state, thereby selectively locking the first and second enhancement members when the first and second frame units are in the unfolded state and thus preventing accidental folding of the first and second frame units.

9. The foldable frame of claim 8, wherein:

the first enhancement member comprises a first slot along at least a portion of the first enhancement member;

the second enhancement member comprises a second slot along at least a portion of the second enhancement member; and the fixation member of the locking mechanism is movable along the first slot of the first enhancement member and the second slot of the second enhancement member.

10. The foldable frame of claim 9, wherein:

the first restriction structure is formed at an end of the first slot of the first enhancement member; and the second restriction structure is formed at an end of the second slot of the second enhancement member.

11. The foldable frame of claim 1, wherein:

the first frame unit further comprises a first leg assembly pivotally coupled with the first mounting assembly at a distal side of the first mounting assembly;

the second frame unit further comprises a second leg assembly pivotally coupled with the second mounting assembly at a distal side of the second mounting assembly.

12. The foldable frame of claim 11, further comprising:

a first supporting assembly coupled with the first leg assembly and first mounting assembly and configured to control rotation of the first leg assembly with respect to the first mounting assembly; and a second supporting assembly coupled with the second leg assembly and second mounting assembly and configured to control rotation of the second leg assembly with respect to the second mounting assembly.

13. The foldable frame of claim 12, wherein:

the first supporting assembly is coupled with an intermediate member of the first leg assembly and a lateral mounting bar of the first mounting assembly; and the second supporting assembly is coupled with an intermediate member of the second leg assembly and a lateral mounting bar of the second mounting assembly.

14. The foldable frame of 12, wherein the first leg assembly comprises a first upper member pivotally coupled with the first mounting assembly at a distal side of the first mounting assembly and a first base member for abutting a ground when the first mounting assembly is in use;

the second leg assembly comprises a second upper member pivotally coupled with the second mounting assembly at a distal side of the second mounting assembly and a second base member for abutting a ground when the second mounting assembly is in use; and the middle leg assembly further comprises a third base member for abutting a ground when the third mounting assembly is in use;

wherein the first, second and third upper members are disposed substantially parallel to each other, and a distance between the first and third upper members is different than a distance between the second and third upper members such that the first, second and third base members are disposed side by side when the foldable frame is folded along a longitudinal direction of the foldable frame.

15. The foldable frame of claim 14, wherein the distance between the first and third upper members is shorter than a distance between the second and third upper members such that the first base member is disposed between the second and third base members when the foldable frame is folded along the longitudinal direction of the foldable frame.

16. The foldable frame of claim 14, wherein:

each of the first and second leg assemblies comprises at least one leg;

the first base member is disposed at an exterior side of a lower end portion of the at least one leg of the first leg assembly;

the second base member is disposed at an exterior side of a lower end portion of the at least one leg of the second leg assembly; and the third base member is disposed at a lower side of a lower end portion of the first or second middle leg of the middle leg assembly.

17. The foldable frame of claim 1, wherein the first and second frame units are unsymmetric.

* * * * *